US006883691B2

(12) United States Patent
Pratt et al.

(10) Patent No.: US 6,883,691 B2
(45) Date of Patent: Apr. 26, 2005

(54) CARRYING DEVICE FOR A CARTABLE ITEM PROVIDING SINGLE TO DUAL-SHOULDER SUPPORT TRANSITIONING

(75) Inventors: Michael James Pratt, Draper, UT (US); Scott Kendrick Warner, Provo, UT (US); Brandon Brent Collette, Draper, UT (US); James Jensen, Orem, UT (US)

(73) Assignee: Ogio International, Inc., Bluffdale, UT (US)

( * ) Notice: Subject to any disclaimer, the term of this patent is extended or adjusted under 35 U.S.C. 154(b) by 27 days.

(21) Appl. No.: 10/289,722

(22) Filed: Nov. 7, 2002

(65) Prior Publication Data

US 2004/0089686 A1 May 13, 2004

(51) Int. Cl.[7] ..... A45F 3/10
(52) U.S. Cl. ..... 224/266; 224/201
(58) Field of Search ..... 224/201, 628, 224/631, 265, 266

(56) References Cited

U.S. PATENT DOCUMENTS

| | | | | | |
|---|---|---|---|---|---|
| 385,429 | A | * | 7/1888 | Sohner | 224/201 |
| 1,150,664 | A | * | 8/1915 | Cramer | 224/265 |
| 1,281,822 | A | | 10/1918 | Orr | |
| 3,009,613 | A | * | 11/1961 | Noland | 224/265 |
| 4,181,117 | A | | 1/1980 | Hannebaum | 126/120 |
| 4,487,347 | A | | 12/1984 | Zegar | 224/259 |
| 4,799,610 | A | | 1/1989 | Hsieh | 224/266 |
| 4,991,738 | A | | 2/1991 | Peterson | 221/1 |
| 5,220,704 | A | | 6/1993 | Flynn et al. | 15/321 |
| 5,222,641 | A | * | 6/1993 | Medeiros, Jr. | 224/161 |
| 5,361,952 | A | | 11/1994 | Gold | 224/159 |
| 5,402,923 | A | | 4/1995 | Snyder | 224/202 |
| 5,464,138 | A | | 11/1995 | Rodriguez | 224/265 |
| 5,573,158 | A | | 11/1996 | Penn | 224/265 |
| 5,593,077 | A | | 1/1997 | Izzo | 224/627 |
| 5,846,169 | A | | 12/1998 | Tscheschlog | 482/105 |
| 6,006,974 | A | | 12/1999 | Varney et al. | 224/645 |
| 6,028,257 | A | | 2/2000 | May | 84/421 |
| 6,152,343 | A | | 11/2000 | Shin | 224/645 |
| 6,305,535 | B1 | | 10/2001 | Fair | 206/315.3 |
| 6,488,189 | B1 | * | 12/2002 | Smith | 224/201 |
| 2002/0025802 | A1 | | 2/2002 | Dupuis | 455/419 |

FOREIGN PATENT DOCUMENTS

| | | | |
|---|---|---|---|
| GB | 190880 | 11/1991 | |
| GB | 2 334 669 A | 1/1999 | A45C/13/26 |
| JP | 07-042481 | 6/1995 | 54/57 |

OTHER PUBLICATIONS

Results of first online patent search on www.online.patolis-.co.jp.
Results of second online patent search on www.online.patolis.co.jp.

* cited by examiner

*Primary Examiner*—Stephen K. Cronin
(74) *Attorney, Agent, or Firm*—Kirton & McConkie; Michael F. Krieger

(57) ABSTRACT

The present invention features a unique carrying device for carrying a cartable item, wherein the carrying device is formed of a rigid structure and comprises means for engaging a first shoulder of a user, means for engaging a second shoulder of a user, means for connecting the means for engaging the first and second shoulders of a user together, means for adjusting the ergonomic configuration of the carrying device, means for releasably coupling or attaching the carrying device to a golf bag, and means for transitioning, upon elective actuation, functions to transition or convert the carrying device from a single-shoulder carrying arrangement or position to a dual-shoulder carrying arrangement or position.

39 Claims, 16 Drawing Sheets

CARRYING DEVICE FOR A CARTABLE ITEM PROVIDING SINGLE TO DUAL-SHOULDER SUPPORT TRANSITIONING

BACKGROUND

1. Field of the Invention

The present invention relates to carrying devices, such as harnesses or straps, designed to attach to or be integrated with containers, backpacks, luggage, bags (e.g., golf bags, mail bags, etc.), and basically any and all cartable items of various sorts, that allow the user to carry and support the cartable item over one or more shoulders using the carrying device. Particularly, the present invention relates to a unique carrying device and system designed to allow a user to initially carry and support a cartable item on a single shoulder, with the added ability to quickly and effortlessly transition the carrying device so that dual-shoulder carrying support of the cartable item is achieved. The present invention also relates to a method of transitioning the carrying device from a single-shoulder carrying support position to a dual-shoulder carrying support position.

2. Background of the Invention and Related Art

Carrying devices, such as harnesses or straps, are commonly found and utilized in everyday situations to support the carrying of cartable items, such as backpacks, golf bags, mail bags, luggage, and a host of others via the shoulder(s) of a user. Many of these prior art carrying items are designed to engage one or more shoulders of the user without offering the choice of one or the other. Moreover, many of these prior art carrying devices are made of soft, flexible materials that tend to cause unnecessary strain and tension on the user.

In particular, such carrying devices are commonly found in the golfing arena. The game of golf is one of the most widely enjoyed sports activities in the world and has strong support at both the recreational level as well as the professional level. While golf has always been an enjoyable game for both novices and professionals, the popularity of the game has exploded in recent years. Record numbers are flocking to beautiful courses worldwide to try their hand at the seemingly arduous task of putting a little white ball in a four inch hole located hundreds of yards away in as few shots as possible. Along with the exploding popularity and record numbers of players, golf equipment has also seen changes. Particularly, as the game of golf requires several different clubs, balls, tees, and other accessories to even play the game, a golf bag has become an indispensable part of any golfer's inventory.

During play, golfers typically travel over a course in one of several ways. For example, a golfer may walk a course and carry his/her clubs, or sometimes employ a caddy to carry the clubs for him/her. Other golfers utilize wheeled pull carts, or motorized or engine driven carts where the golf clubs in a golf bag are mounted to the cart, typically near the rear. Of particular interest herein is those persons who walk a golf course and carry a set of clubs. The present invention is thus useful for a substantial number of golfers who desire walking a golf course as a means of healthy, enjoyable exercise.

One of the drawbacks which has long existed for these golfers is the nature of the construction of the standard golf bag. Traditionally, golf bags have been designed and manufactured having very simple carrying systems with the only thought to provide means by which the golfer could carry the golf bag, which housed both clubs and balls. Here, the typical golf bag used to receive the set of clubs was in the form of a tubular carrying member enclosed at one end so that the shafts of the clubs could be longitudinally received in the bag. Moreover, the traditional carrying systems or devices employed to carry these golf bags consist of a single strap that extends from an upper rim of the golf bag to a mid-point on the bag. The strap is preferably loose and made of flexible material, wherein the golfer or the caddy is able to carry the golf bag by inserting one arm through the strap so that the strap extends across one shoulder, thus supporting the bag for travel. The golf bag resultantly hangs down in a natural resting position depending upon the location and slack in the strap. Although simple in design, this single-strap design has endured through the years and is still very popular today, especially on lower priced golf bags.

Although popular, several disadvantages and deficiencies are present in this design that are readily recognized by those individuals who carry such golf bags over a golf course. One such problem results from the fact that the entire weight of the golf clubs and bag, which may typically be on the order of twenty to thirty pounds, tires the shoulder of the user, especially when several rounds are being played. Such fatigue, due to the weighty nature of the golf bag, potentiates strain of the muscles of the neck, shoulders, and back, which is further perpetuated by the often imbalanced nature of the golf bag relative to the user. For instance, the weight, imbalance, and single strap design can cause associated muscle soreness in the hips and lower back due to the fact that the center of gravity of the bag is offset with respect to the spine of the user. This is of particular concern to those golfers who experience back problems. Another problem associated with the single strap design is the annoying swing or rocking of the golf bag that repeatedly pounds the user over and over as he/she walks from hole to hole. This constant swinging or rocking motion is derived from and is in tune with the natural walking frequency of the user and is difficult to stabilize.

In recent years, these early pioneer bags have been greatly improved upon in an effort to correct these apparent deficiencies, as well as to appeal to the larger, more diverse golfing populous. Some of these designs are briefly described herein.

U.S. Pat. No. 362,752 to Steurer teaches the design for an H-shaped dual strap for a golf bag.

U.S. Pat. No. 387,556 to Beebe et al. teaches the design for a golf bag with dual shoulder straps.

U.S. Pat. No. 348,567 to Dunn teaches the design for a golf bag with a single strap.

U.S. Pat. No. 6,152,343 to Shin describes a monolithic yolk type collar that provides four adjustable straps for two or four point attachment to a golf bag. The collar is adapted to enable transverse mounting of the golf bag on the back of the golfer. The collar has a broad surface with compliant material for comfort and is adapted to take the necessary shape to fit a given golfer.

U.S. Pat. No. 5,593,077 to Izzo provides a shoulder strap assembly for a golf bag. A first shoulder strap extends longitudinally between spaced locations on the outer surface of the bag and a second shoulder strap has opposite connecting ends which are connected in close proximity to one another to the bag adjacent to one of the spaced locations to which the first shoulder strap member is connected and in such a way that the second shoulder strap will extend away from the bag in a generally loop-shaped configuration whereby the bag may be suspended by one or both shoulder straps from one or both shoulders of the golfer or caddy.

U.S. Pat. No. 5,558,259 to Izzo describes a golf bag with a dual carrying strap assembly. In one embodiment, the strap assembly includes a first strap which is attached to the golf bag and interfaces with the golf bag at first and second longitudinally displaced locations. The strap assembly also includes a separate second strap which is also attached to the golf bag and which one end thereof interfaces with the golf bag at the second location and which its other end either interfaces with the golf bag at this same second location or at an intermediate location such as at the carrying handle of the golf bag. Nonetheless, the two separate straps form two loops such that the golf bag may be supported on both of the golfer's shoulders.

U.S. Pat. No. 5,042,703 to Izzo describes a dual shoulder strap assembly for a golf bag having first and second strap members connected in end-to-end relation to one another along one side of the golf bag, a handle grip interconnecting adjoining ends of the strap members, and circumferential loops serve to connect opposite extreme ends of the first and second strap members to the golf bag in such a way as to maintain the bag in centered relation against the back of the carrier when the straps are passed over the shoulders. The upper and lower extreme ends of the strap members are self-adjusting circumferentially, and the adjoining ends between the strap members are interconnected in such a way as to maintain the strap members in an elevated position so that the bag can be easily lifted off the ground and more easily placed on the shoulders of the carrier.

U.S. Pat. No. 5,038,984 to Izzo provides a golf bag that has a support strap assembly that allows carriage by a person. The strap assembly includes a first strap having one strap end secured to the golf bag at a first location at its upper, open end, and the other strap end is secured to the golf bag at a second location longitudinally spaced from the first location. A second strap has one end secured to the golf bag at the second location, and the other strap end is secured to the golf bag at a third location longitudinally spaced from the second location between the second location and the closed end of the golf bag. The ends secured at the second location are preferably attached to one another to form a central portion for the strap assembly. The two straps thus allow the golf bag to be carried on both shoulders and oriented transversely across the back. Various mounts are described for these two straps, and different adjustment and padding structures are disclosed.

U.S. Pat. No. 5,042,704 Izzo describes a golf bag carrying system, in the form of a dual strap carrier, including a first and second strap secured to the golf bag to define arm and shoulder openings. The straps have shoulder pads and one of which may be covered with a relatively slick material. The first strap second end and the second strap first end are attached to a mid-portion of the bag at a central location. The other ends of the first and second straps are secured to the golf bag longitudinally on opposite sides of the central location. The straps include a first and second resilient strap elements at the central location, and the resilient elements terminate at a location spaced from the shoulder pads. These resilient strap elements position thus the straps for easy access. The first, second and third mounts for securing the straps to the bag are selectively adjustable longitudinally along the bag to balance the bag and to adjust for shoulder width. Also, the pads may be laterally arcuate to facilitate wear. Furthermore, a concavity shaped structure may be formed in the bag to conform to the golfer's back.

U.S. Pat. No. 5,636,778 to Jones et al. describes a double strap system for golf bags including a first shoulder strap having upper and lower ends attached to a generally tubular body of a golf bag at first and second locations, respectively. In one embodiment of the double strap system, the lower end of the first shoulder strap is connected to a buckle and slide mechanism which is provided for relocating the second location in a direction that is generally parallel to a length dimension of the golf bag body. A second shoulder strap has opposite ends attached to the golf bag body at third and fourth locations that are spaced apart in another direction. In an alternative embodiment of the double strap system, the lower end of the first shoulder strap may be connected to either one of a pair of attachment devices mounted on the golf bag body to thereby relocate the second location.

U.S. Pat. No. 5,348,205 to Steurer describes a golf bag in the form of a tubular receptacle with a handle thereon having a dual-loop two-point shoulder strap for engaging both shoulders of an individual carrying the golf bag. The shoulder strap, in one embodiment has a single elongated belt with mutually opposed belt ends. One belt end and a first portion of the belt between the belt ends is connected to a first point on a golf bad and defines a first loop through which an individual inserts one arm to support the golf bag at least partially on one shoulder. The other belt end and a second portion of the belt between the belt ends is connected to a second point on the golf bag and defines a second loop through which an individual inserts another arm to support the golf bag at least partially on another shoulder.

U.S. Pat. No. 4,487,347 to Zegar comprises a golf bag and a carrying device. It includes an elongated rigid bar which is attachable to a conventional single strap golf bag. The bar includes perforations. In one embodiment, the two shoulder straps are designed to be adjustable and include provision for quick attachment to and detachment from the elongated rigid bar.

U.S. Pat. No. 5,419,473 to Lamar describes a golf bag to be carried by a user for retaining golf clubs having an elongated tubular container, a shoulder strap system for carrying the container on the user's shoulder and a waist band system for fastening the container to the user's waist to support the weight of the container with the user's lower body. The waist band system including a waist band for fastening around the user's waist and a lumbar pad for providing cushioning to the user's lower back. The golf bag allows the user to transfer the weight of the bag from the shoulders to the lower back to ameliorate fatigue and soreness to the shoulders and to improve the golfer's posture and golf ability.

U.S. Pat. No. 2,853,111 to Williams teaches a golf bag with a pair of circumferential, spaced apart straps for carrying the bag across the back. The straps are fully separated and independent.

Although vast improvements over traditional single-strap designs, several deficiencies are also apparent and exist in these prior art designs. Specifically, Shin teaches a strap enabling transverse mounting of a golf bag. Dunn teaches a single longitudinally oriented shoulder strap. Zegar and Williams each teach the use of separate and independent shoulder straps extending circumferentially from the side of a golf bag. Izzo teaches a single strap configured into a double shoulder loop assembly with three point connection to the golf bag. Lamar, Jones et al, Steurer '205 and Beebe et al each teach dual independent shoulder straps arranged in various ways on the golf bag. Steurer '752 teaches a harness having two separate halves interconnected by a joining strap and a four point connection to the golf bag. These prior art designs either limit the user to a single carrying shoulder, or require the user to undertake significant effort to utilize the dual-shoulder design.

Accordingly, what is needed is a golf bag carrying device that allows a user to support a golf bag on a single shoulder or on both shoulders, with simple, efficient transitioning or conversion between these carrying arrangements.

SUMMARY AND OBJECTS OF THE INVENTION

In light of the deficiencies in prior art designs, the present invention seeks to create a new and unique device, system, and method for carrying various containers, backpacks, luggage, bags, and other similar structures capable of being carried and that are typically used to carry or house various items therein (hereinafter referred to collectively as "cartable item(s)").

To achieve this, the present invention features a carrying device adapted to enable the carrying of a cartable item. The carrying device comprises means for engaging a first shoulder of a user to support carrying of a cartable item, wherein the means for engaging a first shoulder comprises a rigid primary shoulder area; means for electively engaging a second shoulder of a user to provide further carrying support of the cartable item on two shoulders of the user, wherein the means for engaging a second shoulder also comprises a rigid secondary shoulder area; means for connecting the first and second shoulder areas together; means for transitioning the means for electively engaging a second shoulder between a first latent and inactive, off-shoulder position to a second active, secondary cartable item supporting position, wherein the secondary shoulder area is caused to engage the second shoulder of the user, thus effectuating single to dual-shoulder carrying support transitioning of the carrying device; and means for releasably attaching the carrying device to the cartable item.

The transitioning feature of the present invention is intended to be accomplished in a single, smooth and efficient motion with little effort required by the user.

In a preferred embodiment, means for engaging a first shoulder comprises a primary shoulder area having a rigid primary shoulder frame and anterior and dorsal segments that conform to the shoulder/neck area and upper chest area of a user, respectively.

Means for engaging a second shoulder of a user comprises a secondary shoulder area having a rigid secondary shoulder frame, and preferably, anterior and dorsal segments that conform to the shoulder/neck area and upper chest area of a user, respectively. Secondary shoulder area may also comprise a lockable positioning module placed therein to allow an endmost section of the secondary shoulder area to adjustable and lock in multiple interim positions relative to a stationary section of the secondary shoulder area, such as allowing an anterior section to adjust and lock in multiple positions relative to a stationary dorsal segment. In this embodiment, the lockable positioning module provides the ability to lower and raise the endmost section and lock it in one of the interim positions as desired.

Means for connecting the primary shoulder areas together comprises a shoulder bridge, also preferably rigid in construction, that spans between the primary and secondary shoulder areas. This shoulder bridge may or may not comprise adjustment means for adjusting the carrying device to better fit various sized and built users.

The present invention further features means for adjusting the carrying device comprising an adjustment assembly capable of allowing precise lateral, rotational, and transverse adjustment of the carrying device, and particularly the primary and secondary shoulder areas with respect to one another.

The present invention still further features means for releasably attaching the carrying device to the cartable item, wherein the means for releasably attaching preferably comprises a support strap assembly having dorsal and lateral support straps. In one exemplary embodiment, the dorsal support strap attaches to the shoulder bridge of the carrying device and to one or more attachment points located on the cartable item at or near the shoulder bridge. Also in an exemplary embodiment, the lateral support strap attaches to the means for transitioning as well as to an attachment located on a front section of the cartable item. Means for releasably attaching further comprises a restraint that extends in an opposite direction from the lateral support strap around the body of the user to attach to the cartable item. The restraint functions much like the lateral support strap, but provides counter-rotational support to the cartable item opposite that of the lateral support strap. The restraint can attach to at least one point on the means for engaging a first shoulder of a user, and particularly the primary shoulder area, or it may be adapted to attach to at least one point on the means for transitioning. Additionally, the restraint attaches to at least one point on the cartable item. The restraint contemplates utilizing any known attachment means in the art.

Means for transitioning functions with the primary shoulder area, such that it either integrally forms with the primary shoulder area, couples or releasably couples to the primary shoulder area, or is actually a part of the primary shoulder area. In one exemplary embodiment, means for transitioning comprises a transitioning arm that either is integrally formed with or releasably couples to the primary shoulder area, and that extends from the primary shoulder area. Means for transitioning may also comprise a grip of some sort and a palm rest built therein for facilitating or actuating the means for transitioning.

In one exemplary embodiment, actuation of the means for transitioning is achieved by lifting and rotating the transitioning arm, which induces a corresponding rotation and lift of the secondary shoulder area. Further manipulation of the transitioning arm allows the user to properly position the secondary shoulder area so that it engages the second, previously unoccupied shoulder of the user, thus effectuating the transitioning of the carrying device between a single-shoulder carrying support arrangement to a dual-shoulder carrying support arrangement.

Although the present invention is adaptable to any type of cartable item as defined above, in a preferred, although exemplary, embodiment, the present invention features a golf bag carrying system or device adapted to be coupled to or integrally formed with a golf bag for the purpose of providing means to carry the golf bag. In a similar manner, this preferred embodiment also features a method for carrying a golf bag and for transitioning the carrying device from single to dual-shoulder carrying support of the golf bag.

The present invention golf bag carrying system, device, and method offers a unique and complete paradigm shift from the traditional and modem styled golf bag carrying systems, devices, and methods described above, as well as others not mentioned, and provides a new way for a golfer or a caddy to carry a golf bag while walking a golf course.

This unique system, in accordance with the invention as embodied and broadly described herein, features a golf bag carrying device having a rigid structure and comprising means for engaging a first shoulder of a user, means for engaging a second shoulder of a user, means for connecting the means for engaging the first and second shoulders of a user together, means for adjusting the carrying device, means for releasably coupling or attaching the carrying device to a golf bag, and a transitioning arm that, upon elective actuation, transitions or converts the carrying device from a single-shoulder carrying support arrangement or position to a dual-shoulder carrying support position.

In a more specific example, the golf bag carrying device comprises a primary shoulder area comprising a primary shoulder frame, wherein the primary shoulder area is designed to be initially positioned on a first shoulder of a user to support a golf bag; a secondary shoulder area complimentary to the primary shoulder area and adapted to be electively positioned on the second shoulder of said user, wherein the secondary shoulder area comprises a secondary shoulder frame; a shoulder bridge connecting the primary shoulder frame with the secondary shoulder frame; a transitioning arm formed with the primary shoulder frame, wherein the transitioning arm functions to effectuate the engagement, by the secondary shoulder frame, of a second shoulder of the user by transitioning the secondary shoulder frame from a first latent and inactive, off-shoulder position to a second active, secondary golf bag supporting position, thus effectuating single to dual-shoulder support transitioning of the golf bag carrying device; an adjustment area comprising an adjustment assembly for selectively adjusting the primary shoulder area relative to the secondary shoulder area and body of the user; a dorsal support strap releasably coupled to the primary and secondary shoulder frames at respective anchoring points; and a lateral support strap comprising a first end that attaches to the golf bag carrying device and a second end that attaches to the golf bag.

Finally, the present invention features a mainstay and/or component integration concept that eliminates support straps, as commonly existing and known, on backpacks and replaces them with the carrying device as described herein. Specifically, the present invention features a cartable item comprising the carrying device of the present invention integrally formed with or coupled to a pre-existing mainstay or other component of the backpack.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
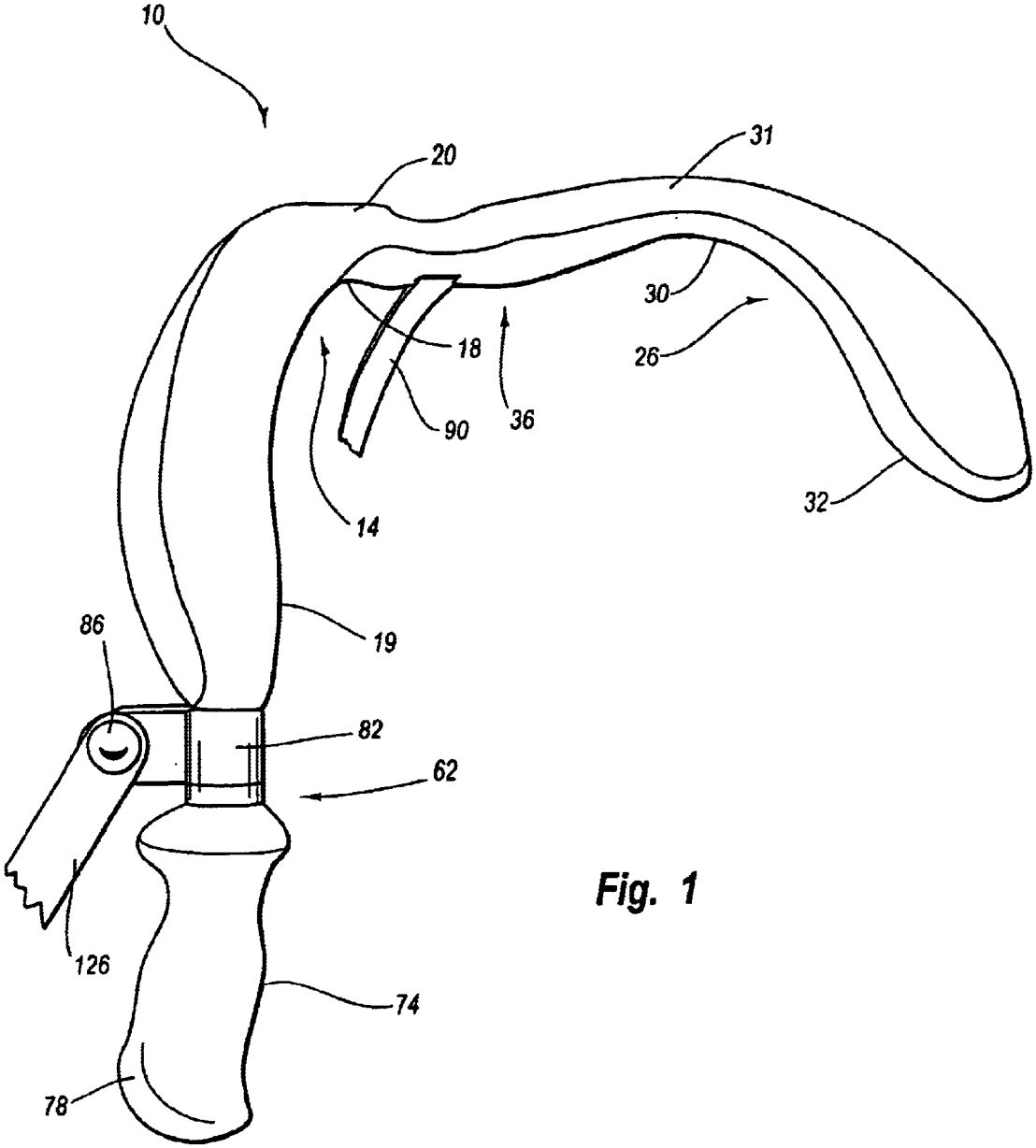
FIG. 1 illustrates a front view of a integrally formed carrying device, according to an exemplary embodiment of the present invention.
Figure 2:
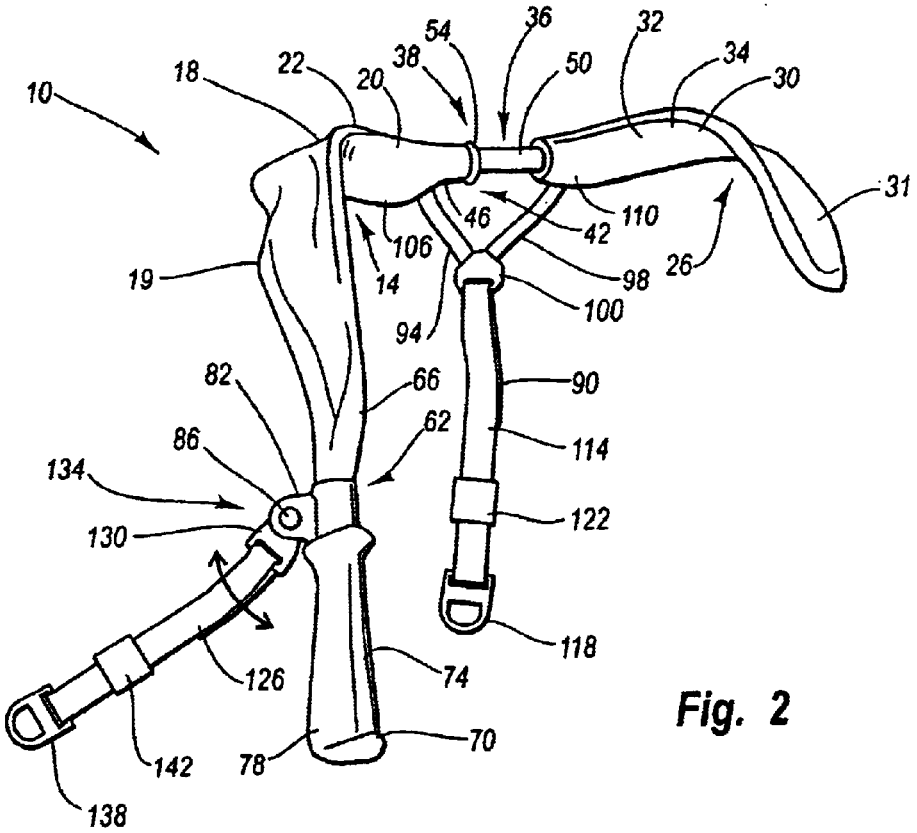
FIG. 2 illustrates a front view of a carrying device having several additional components according to one exemplary embodiment of the present invention.
Figure 3:
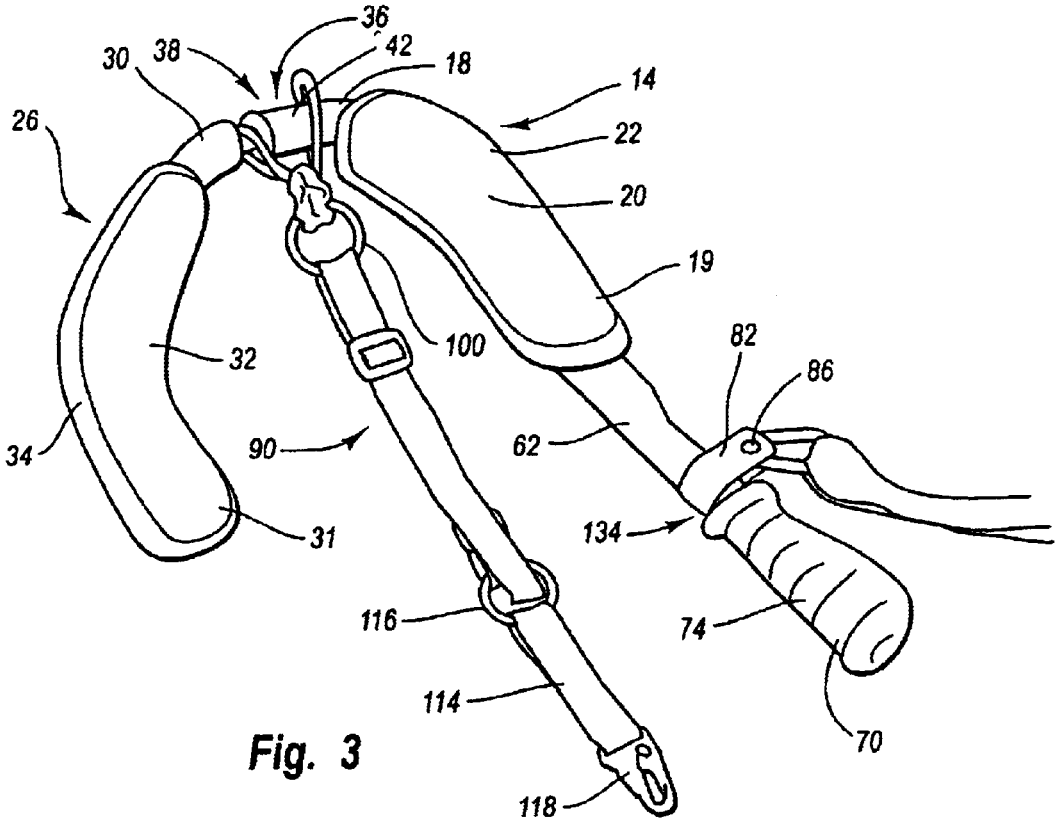
FIG. 3 illustrates a rear view of the carrying device according to one exemplary embodiment of the present invention.

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 17, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

The present invention features a unique paradigm shift from prior art carrying devices designed to be supported on the shoulders of a user and that attach to a cartable item. This paradigm shift is primarily achieved through the method, device, and system for carrying a cartable item as descriptively taught, shown, and claimed herein. Simply stated, the present invention describes and features a method, device, and system for carrying a cartable item, wherein the user is able to transition or convert the carrying device from a single-shoulder carrying device to a dual-shoulder carrying device by actuating one of several means for transitioning the carrying device as discussed in detail herein. This transitioning feature of the present invention is intended to be accomplished in a single, smooth and efficient motion with little effort required by the user.

Several unique features and advantages are found in the present invention carrying device, most of which are recited and explained below. Likewise, those not specifically recited will be apparent to one of ordinary skill in the art, and are intended to fall within the scope of the present invention.

In order to clearly present the concepts and features of the present invention, the following more detailed description is divided into multiple sections, each highlighting a particular aspect, structure, feature, function, or method of operation of the present invention carrying device. Specifically, the following description is divided into three sections, the first entitled, "Structural Embodiments of the Carrying Device and System;" the second entitled, "Mainstay or Component Integration;" and the third entitled, "Methods of Operation and Function of the Carrying Device and System."

It should be noted that the carrying device and system of the present invention is adaptable for use with any type, style, design, size, or shape of cartable item intended to be physically carried by a user, as well as additional cartable items that are not necessarily intended to be carried by a user, but that may be so adapted or altered. For purposes of the disclosure and scope of the patent herein, a cartable item may be defined as any bag, container, carrier, sack, pack, or similar structure or device that may be physically carried, lugged, borne, supported, or held by a user and that is capable of receiving and containing one or more objects therein. Additionally, a cartable item may be defined as any structure, device, system, machine, object, etc. that a user may desire to physically hold, bear, lug, support or carry using his or her body. Indeed, all possible types, styles, designs, sizes, or shapes of cartable items are not specifically recited, disclosed, shown, or claimed herein, but are nonetheless intended to come within the scope of the disclosure, drawings, and claims as presented and set forth herein, as will be recognized by and apparent to one of ordinary skill in the art.

Structural Embodiments of the Carrying Device and System

FIGS. 1–5 present or illustrate a several perspectives of carrying device 10, which highlight or focus on its features, elements, and general structure. With reference to FIG. 1, carrying device and system 10 (hereinafter referred to as "carrying device 10") is shown in its highest level of abstraction as comprising a single, integrally formed design and composition, while FIGS. 2–5 illustrate carrying device 10 as comprising several additional component parts or elements.

Specifically, in each of FIGS. 1–5, carrying device 10 is shown having a rigid structure integrally formed and comprising means for engaging a first shoulder of a user to support carrying of a cartable item; means for electively engaging a second shoulder of a user to provide further carrying support of the cartable item on two shoulders of the user; means for connecting the first and second shoulder areas together; means for transitioning the means for electively engaging a second shoulder between a first latent and inactive, off-shoulder position to a second active, secondary cartable item supporting position, wherein the secondary shoulder area is caused to engage the second shoulder of the user, thus effectuating the transitioning of the carrying device between a single-shoulder carrying device utilizing only a single shoulder of the user and a dual-shoulder carrying device utilizing both shoulders of the user; and means for releasably attaching the carrying device to the cartable item.

Unlike prior art carrying devices that utilize or employ flexible or soft shoulder straps or harnesses, the present invention carrying device 10 comprises a rigid construction throughout its primary makeup that provides certain advantages and benefits that will be described herein. In one exemplary embodiment, carrying device 10 is constructed of plastic material and is formed using one of several manufacturing methods, such as injection molding, casting, etc. Carrying device 10 may also be formed of other materials, such as metal, carbon graphite, or wood, but plastic or a plastic composite is preferable.

Means for engaging a first shoulder of a user comprises a primary shoulder area 14 having an ergonomic design that conforms or substantially conforms to the shoulder and neck area a first shoulder of a user. Primary shoulder area 14 functions as the first area of to engage the first shoulder of the user upon initial utilization of carrying device 10. Stated differently, primary shoulder area 14 is also the section of carrying device 10 that is active during the initial single-shoulder carrying state or arrangement as the user picks up carrying device 10 and causes it to engage his or her shoulder for the purpose of carrying the attached cartable item. In this state, primary shoulder area 14 provides single-shoulder carrying of the cartable item via carrying device 10 operating in a single-shoulder arrangement or position.

Figure 14:
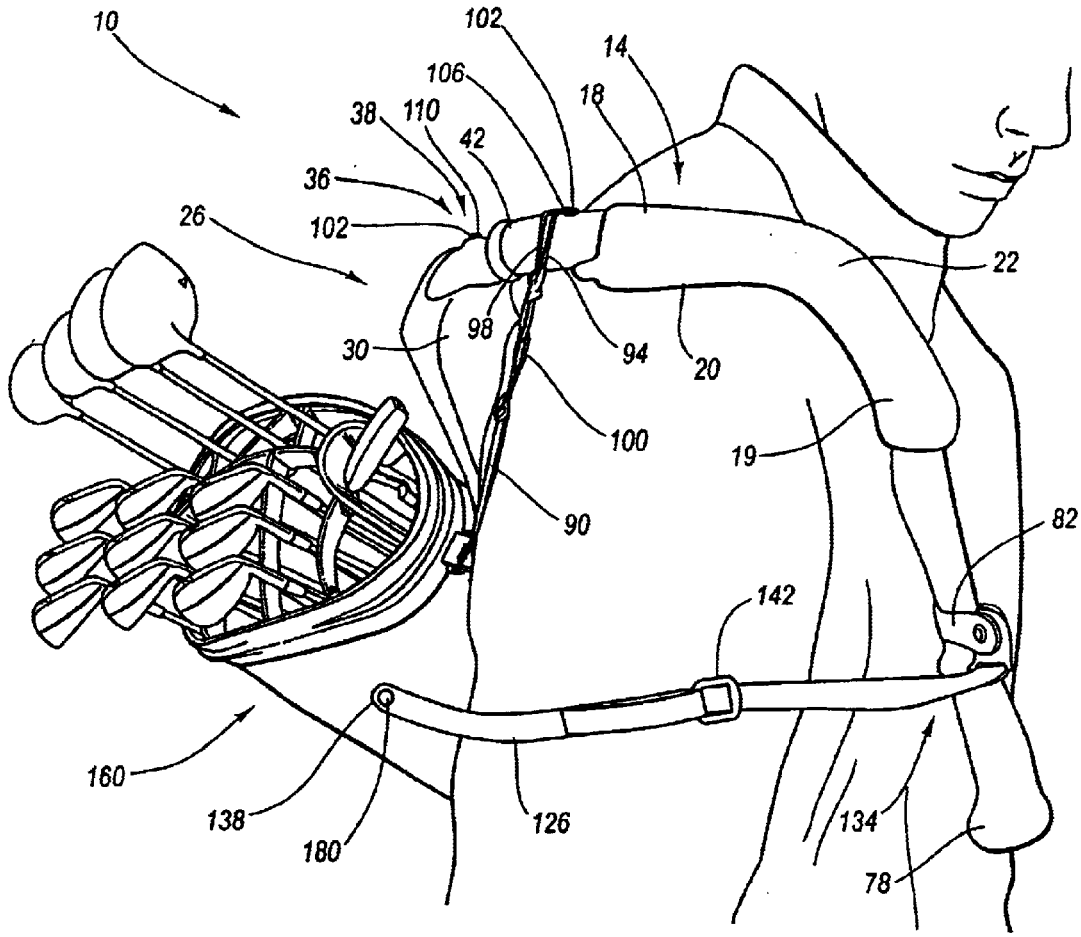
FIG. 14 illustrates the golf bag carrying device as attached to a golf bag and being carried by a golfer in its single-shoulder arrangement according to one exemplary embodiment of the present invention.

Primary shoulder area 14 further comprises several elements therein, such as primary shoulder frame 18. Primary shoulder frame 18 is a rigid member having a contour that fits over and is capable of engaging the first or primary carrying shoulder of the user as shown in FIG. 14. Some embodiments of primary shoulder frame 14 may comprise a dorsal segment 20 and an anterior segment 19 extending from dorsal segment 20. In such embodiments, each of dorsal segment 20 and anterior segment 19 function to improve the fit of and further brace carrying device 10 against the body of the user so as to further limit the movement and displacement of carrying device 10 when it is being used.

Primary shoulder area 14 may further comprise a primary shoulder pad 22 designed to fit over the anterior and dorsal segments 19 and 20 of primary shoulder frame 18. Of course, the size, thickness, stiffness, and arrangement of primary shoulder pad 22 may vary as will be apparent to one of ordinary skill in the art. For example, primary shoulder pad 22 may be removable, which will allow the user to clean or replace the pads as needed. In addition, primary shoulder pad 22 may be manufactured in various sizes, colors, shapes, etc. that will allow the user to incorporate a certain degree of customization to carrying device 10. In addition, primary shoulder pad 22 may comprise over mold padding in the primary shoulder area, and particularly in the single, integrally formed embodiment, which will reduce manufacturing costs and provide for more unitary or integrally formed structure to carrying device 10.

Means for engaging a second shoulder of a user comprises a secondary shoulder area 26 that is preferably rigid in makeup, similar to primary shoulder area 14, and that ergonomically conforms to an opposing, or the second, shoulder area of a user. Secondary shoulder area 26 serves or functions as the second, elective, area that engages a second shoulder of the user upon utilizing carrying device 10. Stated another way, secondary shoulder area 26 is also the section of carrying device 10 that is made active following the transitioning of carrying device 10 to engage the second shoulder of the user, and that functions with primary shoulder area 14 to provide dual-shoulder carrying of the cartable item via carrying device 10 as it operates in this dual-shoulder arrangement or position.

Transitioning of carrying device 10 to cause secondary shoulder area 26 to engage the second shoulder of the user to effectuate dual-shoulder carrying is strictly an elective feature of the present invention to be decided upon by the user. In other words, choosing to utilize carrying device 10 to carry a cartable item on a single shoulder or on both shoulders is entirely up to the user, with either arrangement capable of providing an adequate, functional ability to carry the cartable item. Thus, unless specifically transitioned to the opposing or second shoulder of the user, secondary shoulder area 26 lies dormant and unused. In this dormant position, secondary shoulder area 26 is designed to be or comprises a resting, inactive position that is out of the way and that does not interfere with the functioning of carrying device 10 or the user. As such, the present invention carrying device allows a user to elect either a single-shoulder carrying arrangement or a dual-shoulder carrying arrangement with no interference from carrying device 10 upon selection of either. It should be noted that in the single-shoulder carrying arrangement, primary shoulder area comprises the only part of carrying device 10 that is engaged with the user or is the only area providing carrying support for the cartable item attached to carrying device 10. Naturally, the single-shoulder carrying arrangements does not provide as balanced distribution of weight across the user's body as the dual-shoulder carrying arrangement, but may be the preferred method of carrying the cartable item, especially in situations where carrying device 10 is used for short periods of time. Obviously, for situations where the user will be required to carry the cartable item for an extended period of time, the dual shoulder arrangement may be preferred. This is one of the advantages of the present invention—that the user has the choice of carrying arrangements and the ability to quickly and effortlessly transitions between these two arrangements.

Figure 15:
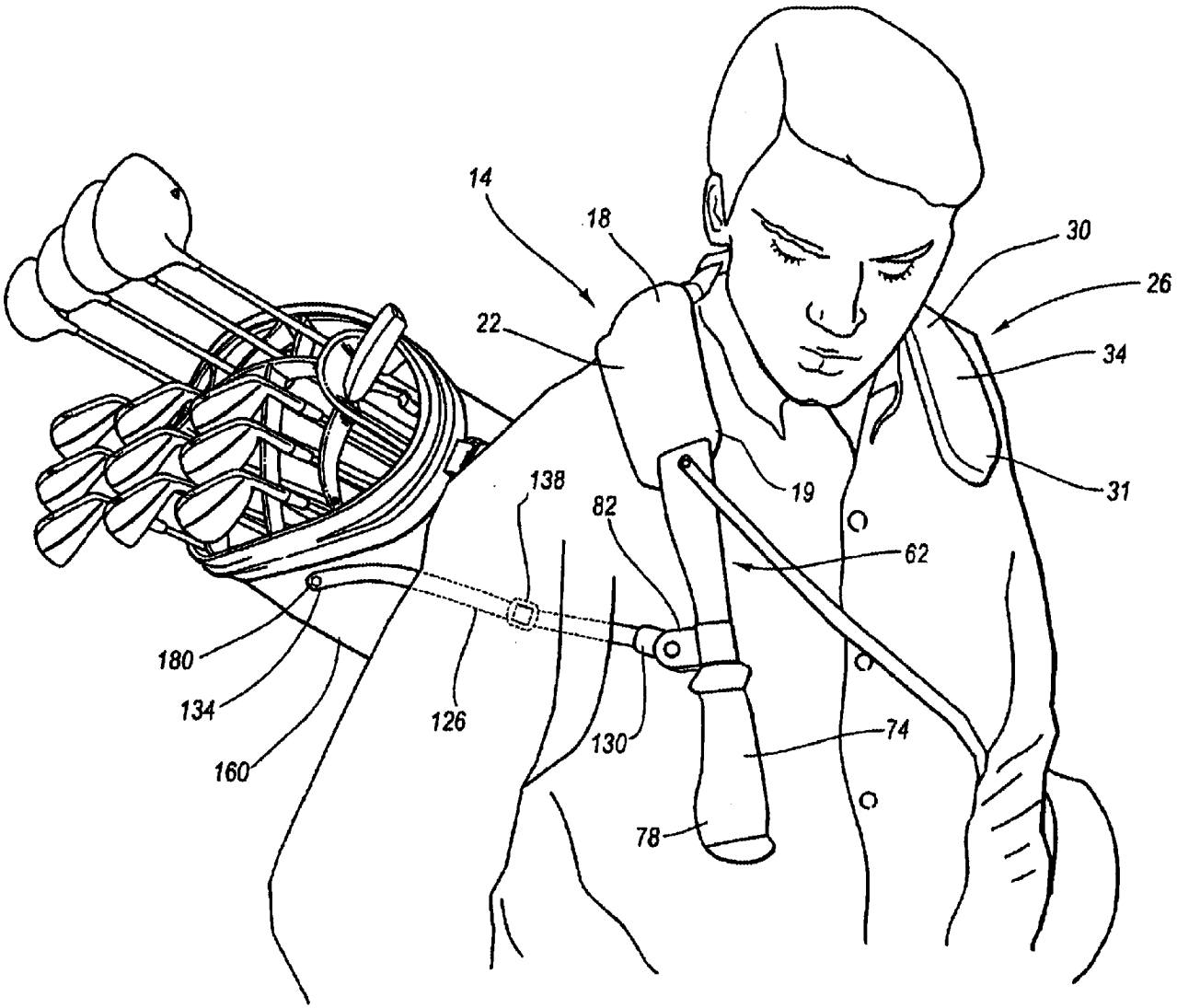
FIG. 15 illustrates the golf bag carrying device as attached to a golf bag and being carried by a golfer in its dual-shoulder arrangement after being transitioned from its single-shoulder arrangement as shown in FIG. 14, according to one exemplary embodiment of the present invention.

Secondary shoulder area 26 may also further comprises several elements therein, such as secondary shoulder frame 30 having a designed contour that fits over and is capable of engaging the second or secondary carrying shoulder of the user (see FIG. 15). Some embodiments of secondary shoulder frame 30, like its primary shoulder frame 18 counterpart, may comprise a dorsal segment 32 and an anterior segment 31 extending from dorsal segment 32. Both dorsal segment 32 and anterior segment 31 on secondary shoulder frame 30 function in a similar manner as anterior segment 19 and dorsal segment 20 described above on primary shoulder frame 18.

Figure 16A:
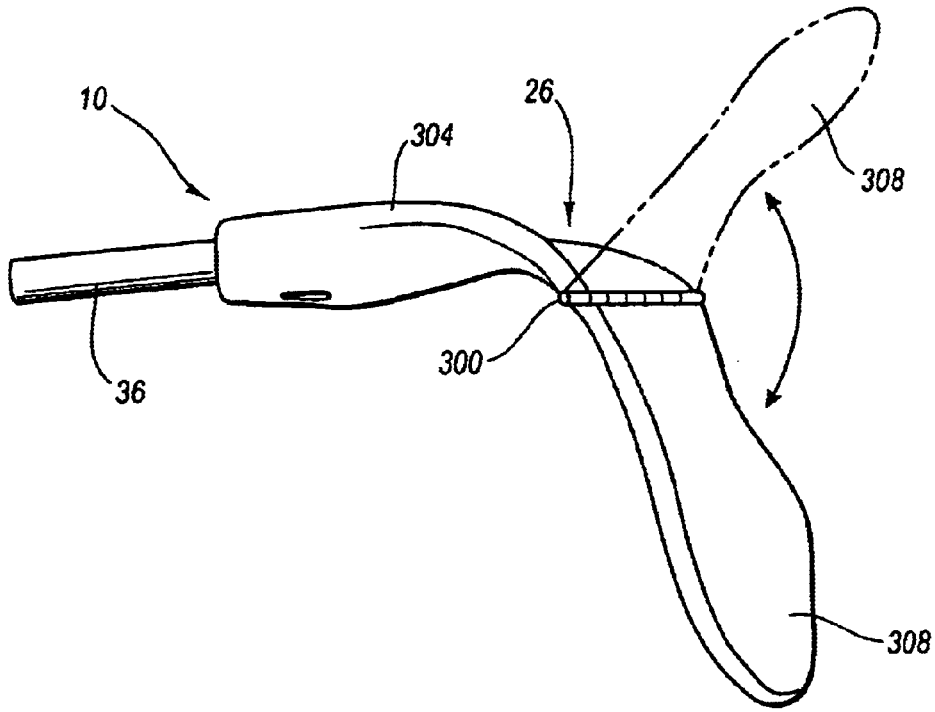
FIGS. 16-A and 16-B illustrate two exemplary embodiments of a lockable positioning module allowing the secondary shoulder area to pivot and rotate with respect to the user, and to allow it to lock into one of several interim positions.
Figure 16B:
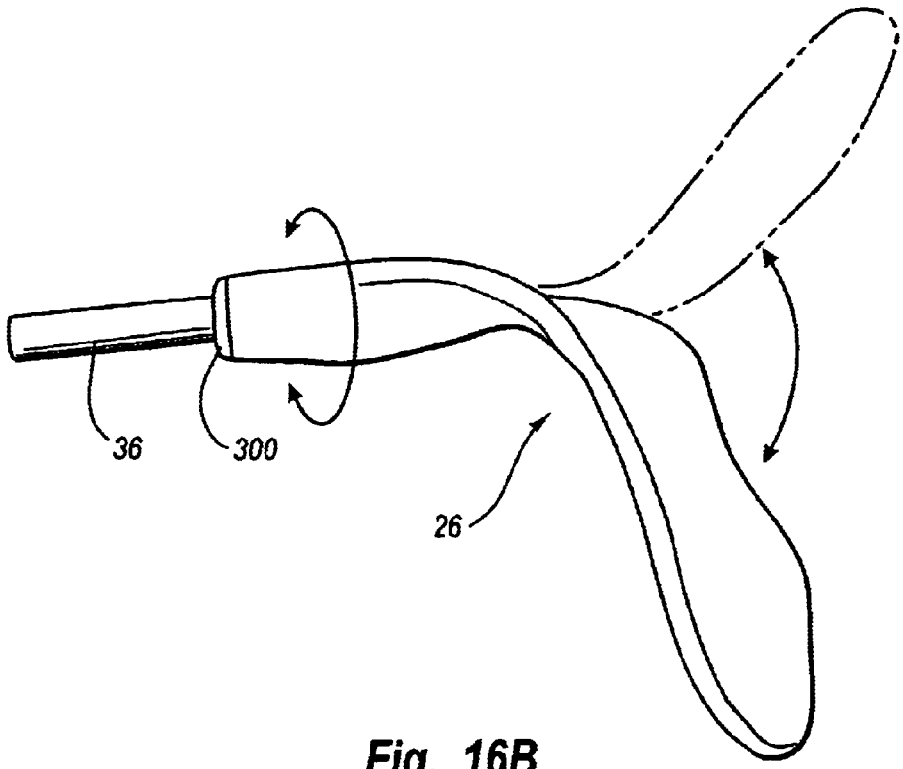

Another contemplated feature of secondary shoulder area 26, shown in FIGS. 16-A and 16-B, comprises means for allowing secondary shoulder area 26 to pivot up and down with respect to the user or away from and toward the body of the user, and to lock into one of several interim positions existing within this range of motion, in the form of a lockable positioning module 300. The direction of rotation of secondary shoulder area 26 is indicated by the arrows in FIGS. 16-A and 16-B.

In one exemplary embodiment, shown specifically in FIG. 16-A, lockable positioning module 300 allows an endmost section of secondary shoulder area 26 to adjust or rotate about a stationary section of secondary shoulder area 26, as well as allowing the endmost section to be able to lock into one of several interim positions relative to the stationary section of secondary shoulder area 26. In this embodiment, secondary shoulder area 26 comprises two separate sections that are connected to one another via lockable positioning module 300. For example, lockable positioning module may be utilized to connect a stationary dorsal section 304 to a pivoting anterior section 308, wherein pivoting anterior 308 section is capable of pivoting with respect to stationary dorsal section 304 and being locked into one of several interim positions made available by and existing in lockable positioning module 300.

In another exemplary embodiment, lockable positioning module may be situated at the junction of secondary shoulder area 26 and support bridge 36 so that the secondary shoulder area 26 pivots in its entirety with respect to or about shoulder bridge 36. In this embodiment, secondary shoulder area 26 may rotate or pivot up and down to allow the user to more easily effectuate the transitioning of carrying device 10 or to obtain a more comfortable fit of carrying device 10 on his or her shoulders.

Lockable positioning module may be any known device or system in the art capable of allowing one section to pivot with respect to another section and subsequently lock in place in one of a multiple of interim positions, including a ratchet system, a quick release mechanism, a slot and insert assembly, or any other similar device, system or assembly. Essentially, lockable positioning module functions to allow secondary shoulder area 26 to be lifted out of the way prior to actuating means for transitioning to facilitate more efficient and less intrusive transitioning of carrying device 10 between its various carrying arrangements. In addition, lockable positioning module functions to allow the user to position secondary shoulder area 26 out of the way prior to causing the secondary shoulder area to engage the second shoulder of the user (either initially positioning carrying device 10 in the dual-shoulder carrying arrangement or by transitioning carrying device 10 to the dual-shoulder carrying arrangement). Once in position, secondary shoulder area 26 (or a section a rotatable section thereof) may be rotated into position to engage the second shoulder of the user. Still further, lockable positioning module functions to allow secondary shoulder area 26 to adjust to various sized users. Indeed, not all body types will be similar and it will be advantageous to provide means by which various users can obtain the most comfortable ergonomic fit possible when utilizing carrying device 10. The ability to adjust secondary shoulder area 26 helps realize this benefit. It should be noted that lockable positioning module comprises a range of motion between 0 and 180 degrees and a plurality of lockable positions therebetween.

Similar to primary shoulder area 14, secondary shoulder area 26 may further comprise a secondary shoulder pad 34 designed to fit over anterior and dorsal segments 31 and 32 of secondary shoulder frame 30. Again, the size, thickness, stiffness, and arrangement of secondary shoulder pad 34 may vary as will be apparent to one of ordinary skill in the art. Anterior segment 31 may further comprise a lateral extension functioning to further stabilize carrying device 10 while in use.

Although mostly apparent, it should be noted that in most embodiments, primary shoulder area 14 and secondary shoulder area 26 will be substantially complimentary to one another in that they consist of essentially equivalent structures only existing or structured in the opposite. Of course, the present invention contemplates various design differences that may be incorporated into each shoulder area, such as the dorsal and anterior segments on primary and secondary shoulder areas 14 and 26, the extension on secondary shoulder area 26, each as described above, or other features or elements. As such, the present invention contemplates any design configuration to be incorporated into primary and secondary shoulder areas 14 and 26 as desired and those specifically recited and illustrated herein are not meant to be limiting in any way.

In one exemplary embodiment, means for connecting the means for engaging the first and second shoulders of a user together comprises a shoulder bridge 36. Shoulder bridge 36 may be a separate piece from either primary shoulder frame 18 or secondary shoulder frame 30, or both, or it may be an integral extension of these. Shoulder bridge 36 is shown joining primary and secondary shoulder areas 14 and 26 together in the form of a substantially horizontal and lateral bridge designed to extend across the lower neck area of the user when carrying device 10 is in a dual-shoulder carrying arrangement. Essentially, shoulder bridge 36 functions to couple or connect and secure primary shoulder area 14 to secondary shoulder area 26 and to provide a support structure that spans across the lower neck portion of the user when carrying device 10 is in use. Shoulder bridge 36 is also preferably rigid in construction and comprises a central axis extending therethrough. In some exemplary embodiments, carrying device 10 is caused to rotate about this central axis, as will be described in greater detail below.

Means for connecting may further comprise, or rather serve as the location for, means for adjusting carrying device 10, and particularly primary and secondary frames 18 and 30, respectively, relative to one another, as is described in greater detail below.

Figure 6A:
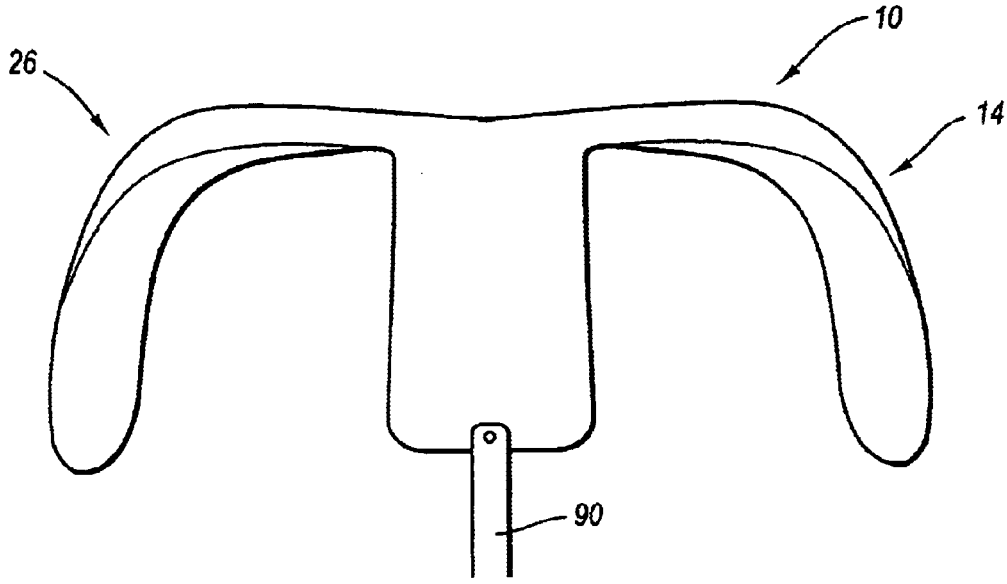
FIGS. 6-A and 6-B illustrate two exemplary designs of a dorsal brace according to two exemplary embodiments of the present invention.
Figure 6B:
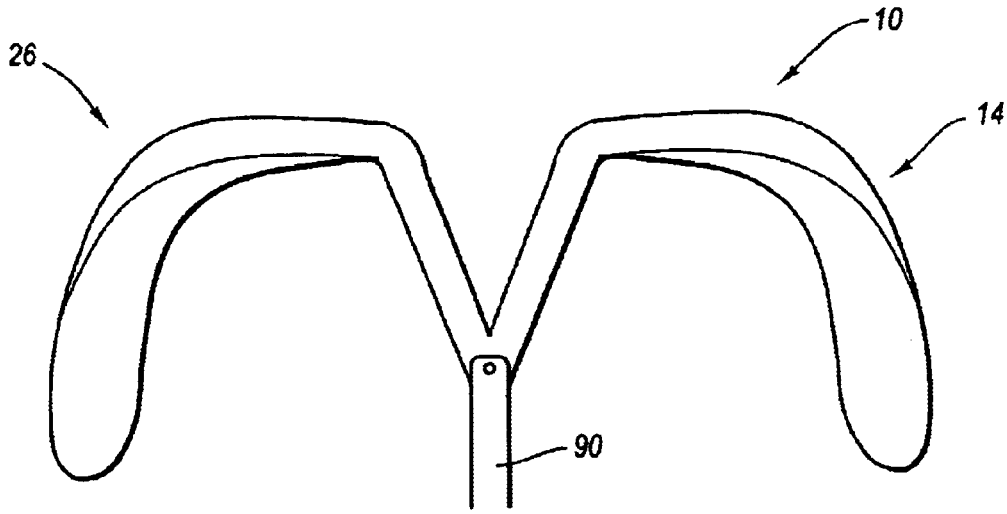
Figure 7:
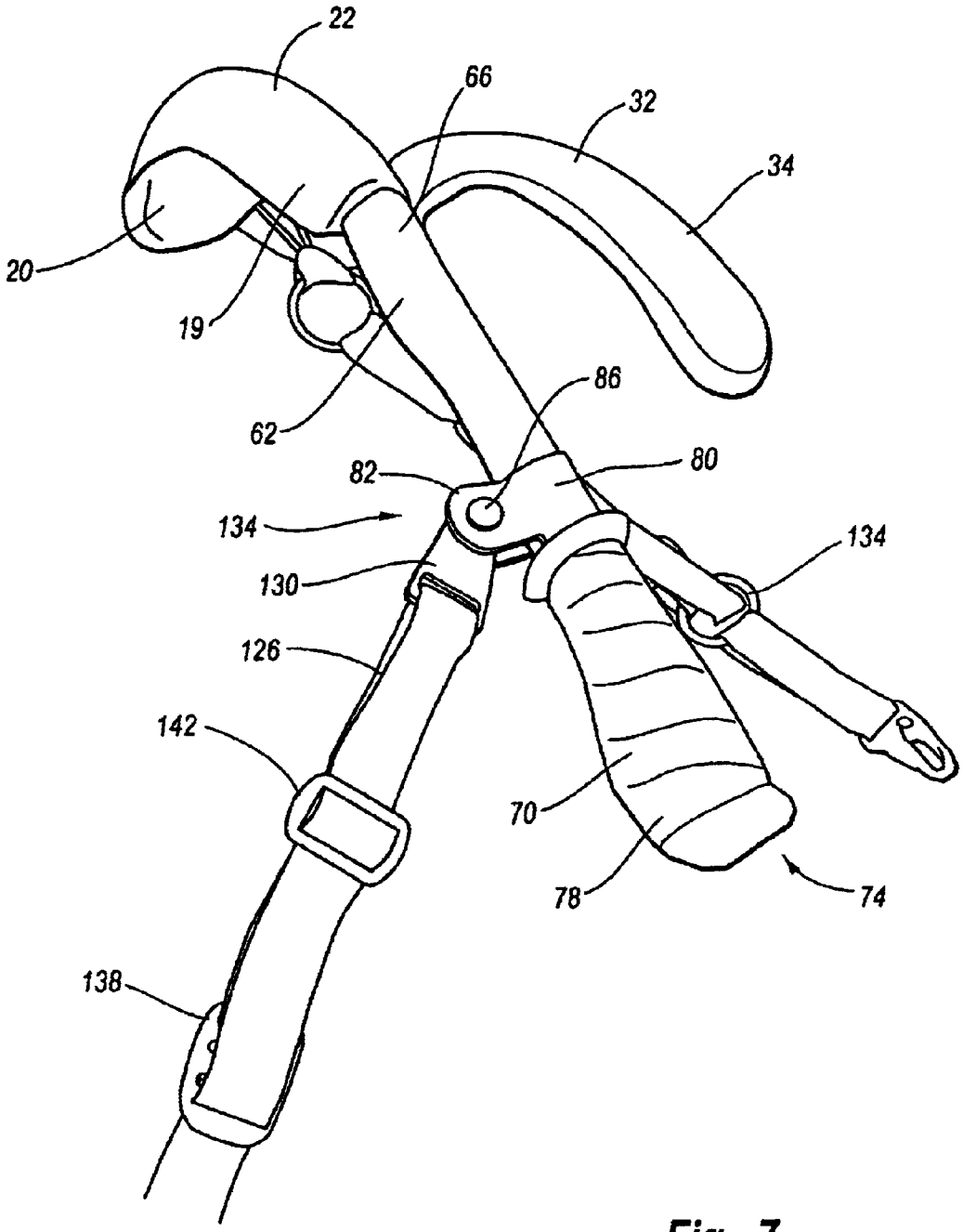
FIG. 7 illustrates a more detailed view of the transitioning arm, the pivoting cuff, the lateral support strap, and the grip and palm rest of the golf bag carrying device according to one exemplary embodiment of the present invention.

Other means for connecting the means for engaging the first and second shoulders of a user together are also contemplated, such as a dorsal brace 150 that extends from each of primary and secondary shoulder areas 14 and 26 down the back of the user. Dorsal brace 150 may comprise various shapes or configurational designs, two of which are shown in FIGS. 6-A and 6-B. Of course, other designs other than those specifically shown and recited herein are contemplated and may be utilized.

As it is designed to ergonomically conform to a user, carrying device 10 may be manufactured in various sizes and shapes (e.g. different sizes and shapes for men and women, as well as children) so different users can select the correct or most ergonomically correct fit that would best allow primary shoulder area 14 and secondary shoulder area 26 to conform to their particular sized and shaped body structure.

As stated, the present invention features means for transitioning the means for electively engaging a second shoulder (e.g. secondary shoulder area 26) between a first latent and inactive, off-shoulder position to a second active, secondary cartable item supporting position. Stated another way, the present invention features means for transitioning carrying device 10 between a single-shoulder carrying device, and associated single-shoulder carrying arrangement, and a dual-shoulder carrying device, and associated dual-shoulder carrying arrangement. These two identical, but semantically different, means (that may collectively be referred to as "means for transitioning") are the same and comprise the same elements to effectuate such transitioning function.

Specifically, means for transitioning may comprise several different embodiments. With reference to FIGS. 1–5 and 7–10, the present invention means for transitioning comprises a transitioning arm 62 that functions to transition or convert carrying device 10 between a single-shoulder carrying arrangement or position and a dual-shoulder carrying arrangement or position.

In the exemplary embodiment shown in FIGS. 1–5 and 7, transitioning arm 62 comprises a rigid arm or extension extending longitudinally downward from anterior segment 19 of primary shoulder area 14. In this embodiment, transitioning arm 62 comprises an upper segment 66 proximate primary shoulder area 14 and a lower segment 70 distal primary shoulder area 14 and integrally formed with upper segment 66. In this particular embodiment, transitioning arm 62 comprises a single, unitary structure that is integrally formed with primary shoulder area 14, and particularly primary shoulder frame 18 so that carrying device 10 and its component elements comprise a single, unitary piece.

Figure 8:
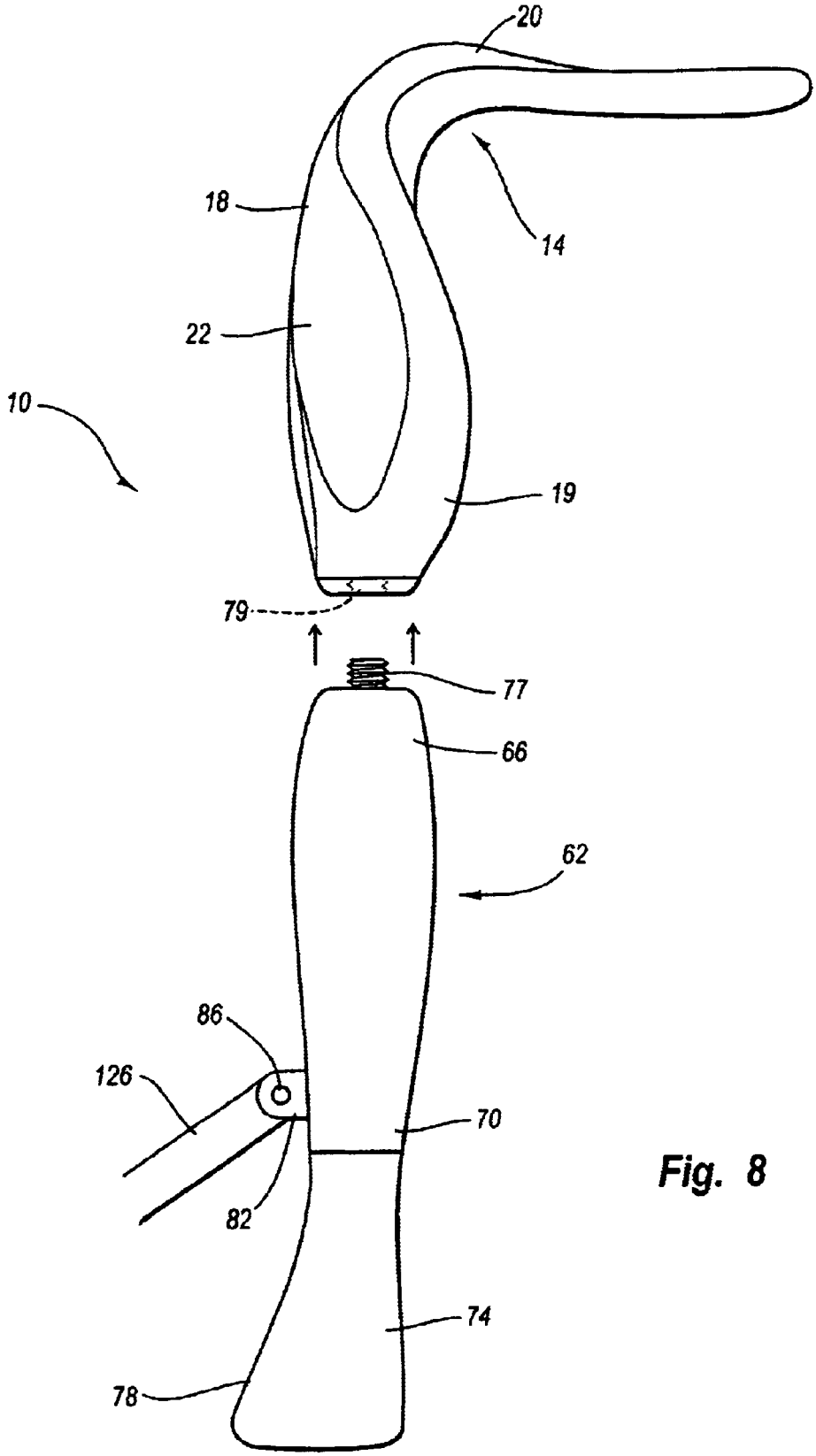
FIG. 8 illustrates an exemplary embodiment of means for transitioning, and particularly transitioning arm as being separably or removably coupled to the primary shoulder area of the carrying device.

In an alternative embodiment shown in FIG. 8, transitioning arm 62 may be a separate structural piece that is removably attached or coupled to primary shoulder area 14. In this embodiment, transitioning arm 62 is removably attached using any attachment means known in the art. In a preferred embodiment, attachment means comprises a threaded male portion 77 that screws into a matching threaded female aperture 79 using reverse threading so that any rotational forces applied to transitioning arm 62 by the user to effectuate the transitioning feature will no cause transitioning arm 62 to loosen, but will instead function to keep a tight fit between transitioning arm 62 and primary shoulder area 14. Attachment means may also comprise a quick release mechanism as commonly known, or any other similar means capable of securely, but removably, attaching transitioning arm 62 to primary shoulder frame 14.

Figure 9A:
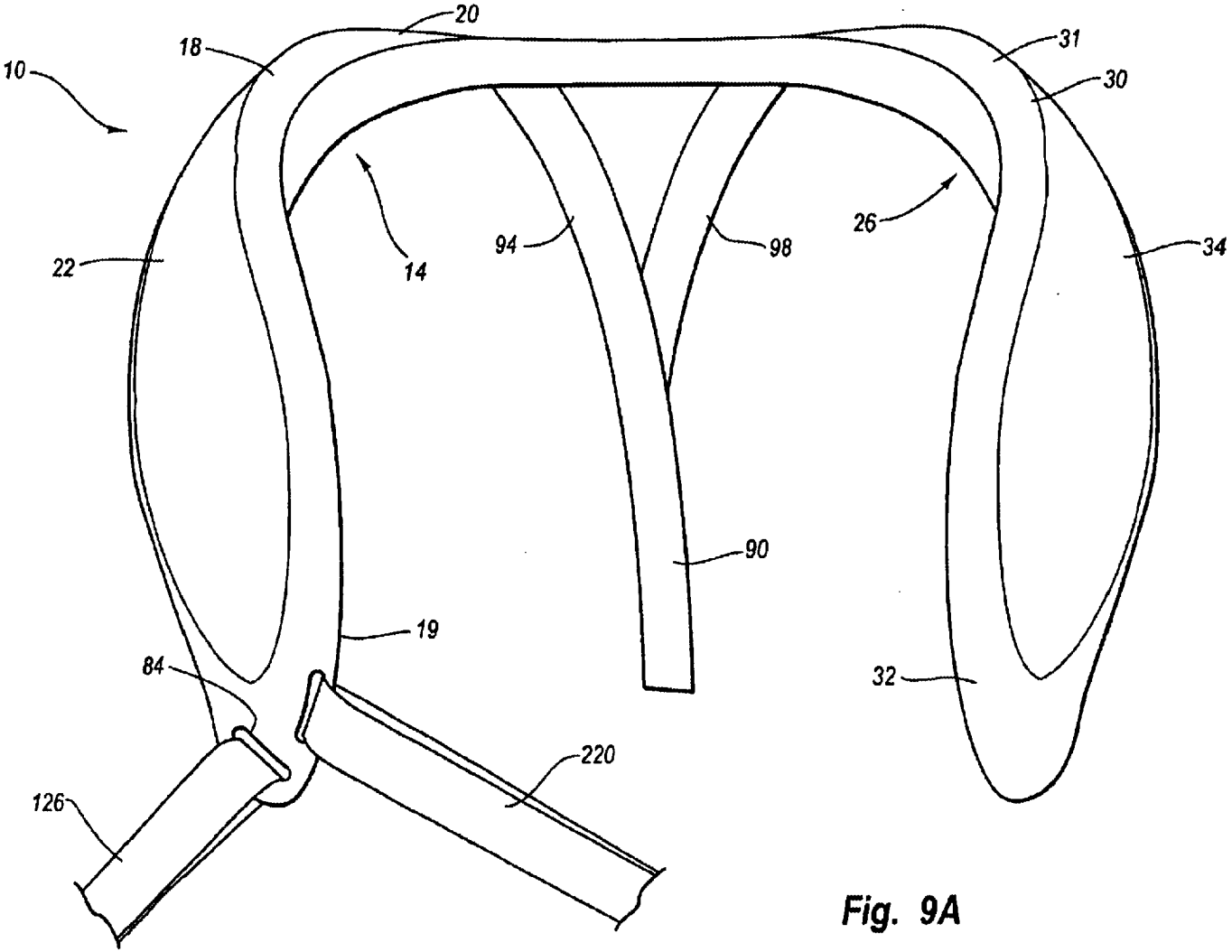
FIGS. 9-A and 9-B illustrate another exemplary embodiment of means for transitioning, and particularly means for transitioning as it is built directly into the structure of the primary shoulder area of the carrying device, as well as s more simplified attachment of the later support strap, according to an exemplary embodiment of the present invention.
Figure 9B:
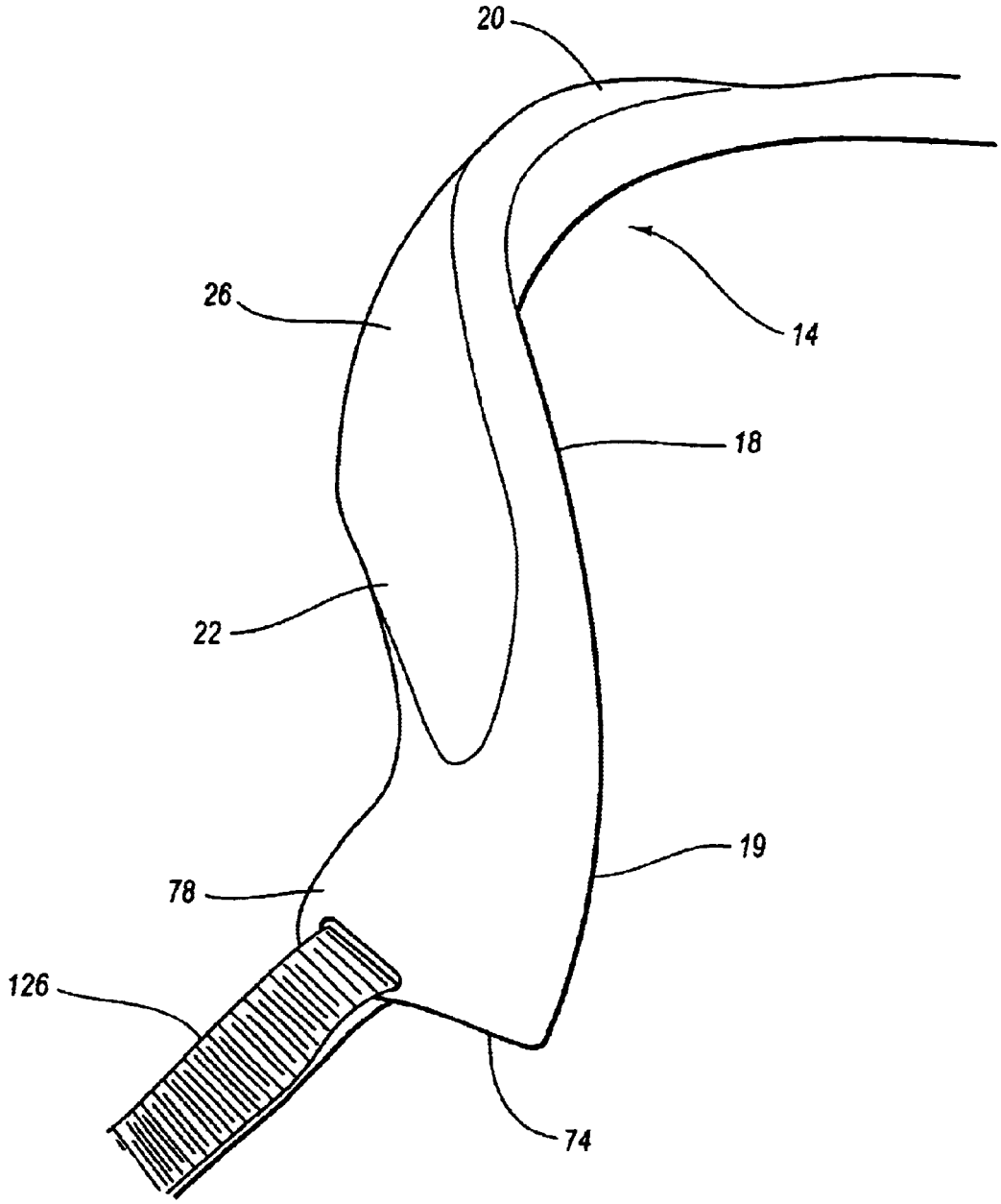

In still another embodiment shown in FIG. 9, transitioning arm 62 may comprise a portion of primary shoulder area 14 itself. For example, as shown in FIG. 9, primary shoulder area 14 comprises primary shoulder frame 18 having anterior segment 19. In this embodiment, anterior segment 19 comprises a section designed to be grasped and manipulated by the user to effectuate transitioning of carrying device 10, which essentially allows anterior segment 19 of primary shoulder frame 18 to function in a similar manner as transitioning arm 62 of other embodiments.

In yet another embodiment, transitioning arm 62 may comprise a pull-strap or other similar device attached to either primary or secondary shoulder frames 18 and 30, respectively, to effectuate the means of transitioning secondary shoulder area 26 on and off the second shoulder of a user.

In any event, means for transitioning and its relationship to primary shoulder area 14 must be such that means for transitioning can be used to effectively manipulate carrying device 10, and particularly secondary shoulder area 26 or frame 30, via primary shoulder area 14 or frame 18, to transition carrying device 10 between a single-shoulder carrying arrangement and a dual-shoulder carrying arrangement on a user as desired by the user. Indeed, one ordinarily skilled in the art will recognize the many possible design configurations that means for transitioning may comprise. As such, those specifically recited and discussed herein are not meant to be limiting in any way. Means for transitioning and the correlating rigid primary and secondary shoulder areas are unique features of the present invention and are not found in prior art carrying device designs. Moreover, means for transitioning provides unique functionality to the present invention carrying device and system, as well as providing for many advantages and benefits not found in prior art designs. Therefore, as the present invention carrying device, with its means for transitioning and unique design, presents a complete paradigm shift from conventional wisdom, it is intended that any structure, device, configuration, system, or arrangement performing the function of manipulating a carrying device so that a second shoulder area transitions between an "on shoulder" and "off shoulder" position be within the scope of the present invention as described, illustrated, and claimed herein.

Figure 10:
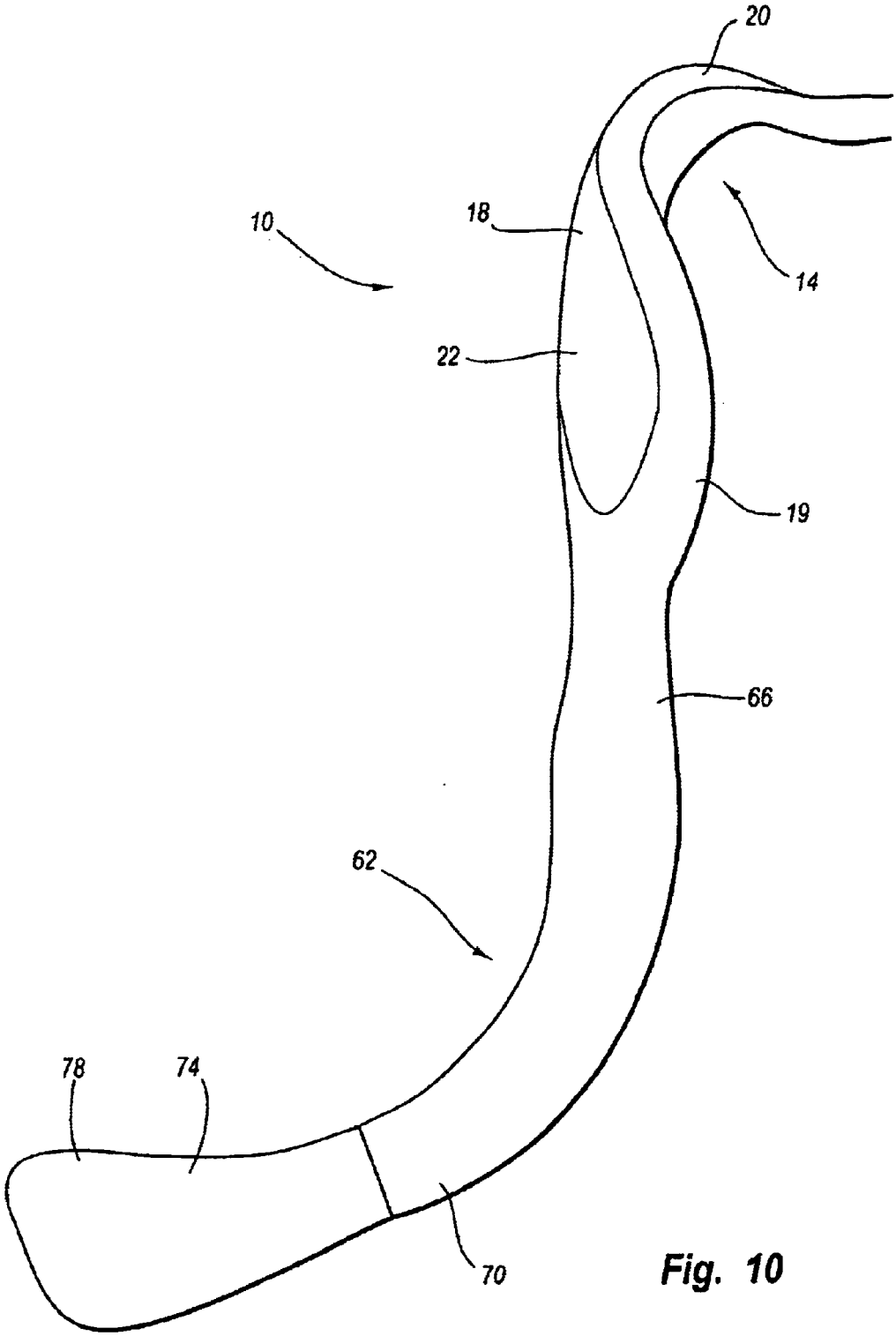
FIG. 10 illustrates still another exemplary embodiment of means for transitioning, and particularly means for transitioning as it comprises one or more curved spline formations therein.
Figure 11:
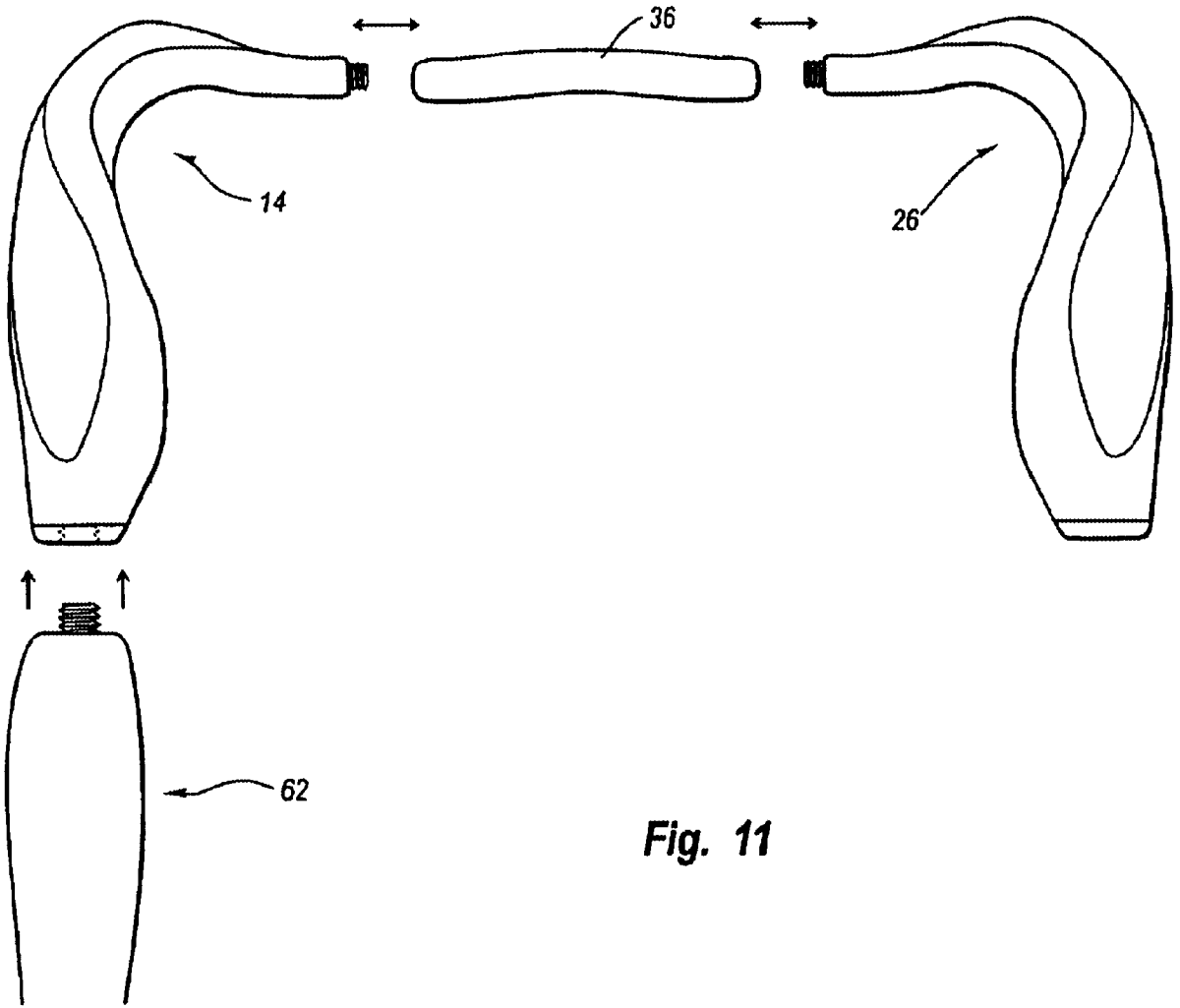
FIG. 11 illustrates an exemplary embodiment of the carrying device showing how each of the components may be removably coupled to one another to provide for more precise adjustment of the carrying device to better fit various users.

In an alternative embodiment, shown in FIG. 10, transitioning arm 62 comprises a curved spline formation. Specifically, transitioning arm 62 comprises an upper segment having a curved spline formation integrally formed with a lower segment also having a curved spline formation. Providing a curved spline formation in transitioning arm 62 functions to facilitate its intended function, that of effectuating transition of carrying device 10 between and single-shoulder carrying arrangement and a dual-shoulder carrying arrangement, by providing greater leverage to be built into transitioning arm 62. In effect, a user is assisted in his or her efforts to effectuate transitioning because the curved nature of transitioning arm 62 provides the user with added leverage to manipulate and rotate transitioning arm 62. The present invention contemplates and any particular curved spline formation found within transitioning arm 62, but preferably, the upper segment is curved in a concave manner with respect to the body of the user and the lower segment is curved in an outward manner from the upper segment. Moreover, the present invention contemplates any radius of curvature to be within the scope of the description provided herein.

Means for transitioning further comprises a structure that is graspable by the user and used to facilitate transitioning of carrying device 10 between a single-shoulder carrying arrangement and a dual-shoulder carrying arrangement. In the exemplary embodiments shown herein, means for transitioning comprises a handle portion or grip 74 that and a corresponding palm rest 78.

With reference to the embodiment shown in FIGS. 1–5, transitioning arm 62 is shown comprising grip 74. Grip 74 is positioned along lower segment 70 and functions to provide an identified or designated and specific place for the user to grasp while actuating transitioning arm 62. Grip 74 may be equipped with rubber or other similar material to decrease slipping within the users hand during the actuation phase. Transitioning arm 62 is also shown comprising palm rest 78 integrally formed with or otherwise coupled to grip 74. Palm rest 78 extends outward from grip 74 and functions to provide leverage for the user to utilize when actuating transitioning arm 62. Palm rest 78 essentially facilitates the rotation of transitioning arm 62 discussed above as it allows the user to exert a greater moment or rotational force on transitioning arm 62. Stated differently, palm rest 78, with its relative position on grip 74 and transitioning arm 62 and extending structure, effectively comprises a moment arm that causes transitioning arm 62 to rotate about its axis, which ultimately causes secondary shoulder area 26 to convert between its two identified positions. As is well known in the art, the magnitude of the moment of a force acting about a point or axis is directly proportional to the distance of the force from the point or axis. In this case, the greater the distance palm rest 78 extends from the central axis and axis of rotation of transitioning arm 62, the greater the moment arm created and the easier it will be to induce a moment or rotational force that rotates transitioning arm 62 about its central axis.

With reference to the embodiment shown in FIG. 9, primary shoulder area 14, and particularly anterior segment 19, comprises grip 74 and an optionally associated palm rest 78. In this embodiment, as explained above, primary shoulder area 14 may be adapted to comprise means for transitioning. Therefore, primary shoulder area, and particularly anterior segment 19 of primary shoulder frame 18, is equipped with grip 74 and palm rest 78 so that a user may simply grasp grip 74 on primary shoulder area 14, manipulate it as necessary, and transition carrying device 10 between a single-shoulder carrying arrangement and a dual-shoulder carrying arrangement as explained herein. Any type of structure may be incorporated into primary shoulder area 14 to allow the user to actuate the means for transitioning formed therein. In a most simple embodiment, means for transitioning comprises no identified structures to be grasped by the user to effectuate transitioning, but instead comprises any segment of primary shoulder area 14 that the user wishes to grasp. In each of these embodiments, an additional transition arm is not required.

As shown in each of the Figures, means for transitioning features or comprises a structure that the user may grasp and actuate to electively physically manipulate carrying device 10 as desired, thus effectuating the transitioning or conversion of carrying device 10 between a single-shoulder carrying arrangement, where secondary shoulder area 26 is inactive and off the shoulder of the user, and a dual-shoulder carrying arrangement, where secondary shoulder area 26 is actively engaged with a second shoulder of the user opposite the one supporting and engaging primary shoulder area 14. As stated, this process is elective as the attached cartable item may be carried or supported on one or both shoulders of the user through actuation of means for transitioning, regardless of its location or position.

Means for transitioning is actuated by grasping means for transitioning and manipulating it so that secondary shoulder area 26 is raised and rotated into position to engage the second shoulder of the user. As stated, secondary shoulder area 26 comprises a latent, inactive position or state defined by its presence off the second shoulder of the user, and an active, engaged position or state defined by its presence on and engaged with the second shoulder of the user. As such, secondary shoulder area 26 travels through an identified range of motion during its transition between these two states. In one exemplary embodiment, means for transitioning is manipulated so that it is pulled down towards the body of the user and rotated substantially about its central axis. This effectively causes a corresponding upward movement and rotation in secondary shoulder area 26. Once properly positioned, means for transitioning is released, thus allowing secondary shoulder area 26 to come to a resting position engaging the second shoulder of the user. This effectively allows the user to manipulate means for transitioning so that secondary shoulder area 26 engages the previously unoccupied second shoulder of the user. Likewise, to disengage secondary shoulder area 26 from the user's second shoulder, means for transitioning is manipulated in an opposite manner and released when secondary shoulder area 26 has disengaged the second shoulder of the user.

In another exemplary embodiment, instead of carrying device 10 comprising a single, integrally formed structure, carrying device 10 may comprise one or more separate and independent components that are removably coupled to one another to form or construct carrying device 10. Such separate and independent components are provided in an exemplary embodiment shown in FIG. 11, wherein primary shoulder area 14, secondary shoulder area 26, means for transitioning (shown as shoulder bridge 36), and means for transitioning (shown as transitioning arm 62) are removably coupled to one another. Such a design is advantageous in that it allows for a greater number of adjustment points to be incorporated into carrying device 10 to better accommodate various sized and shaped users, as discussed below. The means used to couple each of these components together may be any means commonly known in the art, such as matching threaded male and female portions.

As indicated, the present invention further features means for adjusting carrying device to allow carrying device 10 to conform to different individual user body sizes, shapes, heights, proportions, etc. Means for adjusting is intended to be quick and efficient so as to allow a user to quickly adjust carrying device 10 as needed or desired. With reference to FIGS. 2–5 and 12, shown is one exemplary embodiment where means for adjusting comprises a general adjustment area positioned along or within means for connecting primary and secondary shoulder areas 14 and 26 together. In this exemplary embodiment, means for connecting comprises shoulder bridge 36.

Also in this exemplary embodiment, means for adjusting is shown comprising an adjustment assembly 42 designed to provide relative adjustment of carrying device 10, and particularly the adjustment of primary shoulder area 14 relative to secondary shoulder area 26, wherein adjustment assembly 42 comprises a coupling 46 rigidly attached to either one of primary shoulder frame 18 or secondary shoulder frame 30, an insert member 50 rigidly attached opposite coupling 46 and also to either one of primary shoulder frame 18 or secondary shoulder frame 30. Insert member 50, although rigidly attached, is designed to be rotatable or rotatably inserted within coupling 46, thus allowing primary shoulder area 14 to pivot, with respect to secondary shoulder area 26, about the central axis of shoulder bridge 36, as well as to slide laterally or bi-directionally therein in order to achieve an optimal ergonomic arrangement that conforms to the selective shoulder area of the individual user. This lateral and rotational range of motion is illustrated by the arrows in FIG. 6.

Adjustment assembly 42 further comprises means for locking adjustment assembly 42, and particularly insert member 50, in place. Means for locking adjustment assembly 42 in place may comprise any known means in the art. However, the present invention contemplates use of an index module, a quick release mechanism, or a threaded finger tightening screw. Each of these means for locking are intended to lock adjustment assembly in one of a plurality of pre-set or pre-determined positions that conform to the particular size and shape of the user.

Other means for adjusting are also contemplated herein. For example, as indicated above, each of the major components of carrying device 10, namely primary shoulder area 14, secondary shoulder area 26, means for connecting these (e.g., shoulder bridge 36), and means for transitioning (e.g., transitioning arm 62), may each comprise separate and independent parts that all removably couple together in some manner to form carrying device 10 (see FIG. 11). Or, some components may be integrally formed with one another with the remaining components separate and independent, thus requiring them to be coupled to those that are integrally formed. In any event, each of these components may comprise a similar means for adjusting to allow precise adjustment of that component in relation to its associate counterpart. For example, transitioning arm 62 may be adjustable with respect to primary shoulder area 14. Primary shoulder area 14 may be adjustable with respect to transitioning arm 62, or shoulder bridge 36 and consequently secondary shoulder area 26. Likewise, secondary shoulder area 26 may be adjustable with respect to shoulder bridge 36, and consequently primary shoulder area 14. In addition, each of these components may comprise means for adjusting that particular component. For example, transitioning arm 62 may comprise means for adjusting transitioning arm 62 so that one or more segments of transitioning arm 62 are made adjustable. The types of adjustment means may be any commonly known in the art and may include a ratchet system, a finger tightened screw, a quick release mechanism, an indexing assembly, or others.

The present invention further features means for releasably coupling or attaching carrying device 10 to a cartable item. With reference to FIGS. 1–5 and 12–15, shown is one exemplary embodiment comprising a support strap assembly. The support strap assembly shown includes a dorsal support strap 90 that extends from means for connecting primary and secondary shoulder areas 14 and 26 together (shown as shoulder bridge 36) substantially vertically down the back of the user where it attaches to a mid-section of a cartable item 160 (shown as a golf bag). The support strap assembly further includes a lateral support strap 126 that extends from means for transitioning (shown as transitioning arm 62) in a substantially lateral or horizontal direction underneath the arm of the user where it attaches to the frontal part of cartable item 160. Each strap is also capable of being adjusted as needed or desired via an adjustment means, such as a buckle 138 or other similar mechanism commonly known in the art.

Figure 13:
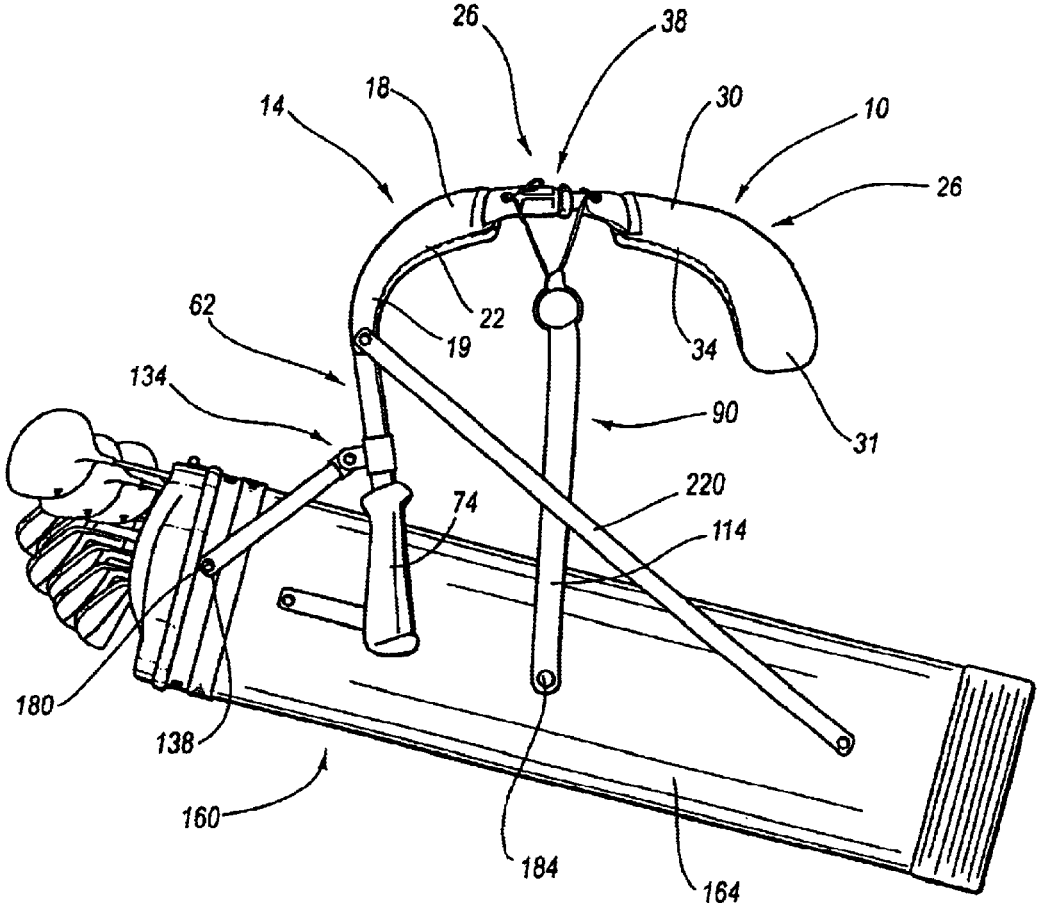
FIG. 13 illustrates the golf bag carrying device of the present invention as coupled to a golf bag, and the relative points of attachment to the golf bag.

Dorsal support strap 90 attaches to cartable item 160 substantially within its mid section, while lateral support strap 126 attaches to cartable item 160 substantially near its top or upper segment, as shown in FIG. 13. However, the present invention contemplates various other attachment points or locations on cartable item 160 depending upon the several factors, including load distribution, the size of the cartable item, the motion that will be experienced while carrying the cartable item, etc. Moreover, the present invention also contemplates means of attachment that is capable of being adjustable between two or more attachment points or that is capable of releasably attaching to multiple attachment points on the cartable item to accommodate changing load distributions or other conditions, wherein such an adjustment would increase and/or maximize the carrying of the cartable item as much as possible. As such, these recited attachment points should not be considered limiting in any way.

As illustrated in the exemplary embodiment, each of the dorsal and lateral strap supports 90 and 126 are attached to cartable item 160 using attachment means 102 and 118, respectively. Attachment means 102 and 118 may comprise any known type of attachment device, system, mechanism, or material capable of securing dorsal strap 90 and lateral support strap 126 to cartable item 160.

In one exemplary embodiment, dorsal support strap 90, which is intended to provide vertical support to cartable item 160, comprises a primary strap or strap portion 92, a first and second strap extension 94 and 98, respectively, a coupler 100 allowing two separate dorsal strap pieces to branch therefrom, attachment means 102 and 118 capable of attaching dorsal strap 90 to both carrying device 10 and golf bag 160, respectively, and a biasing member 114 that allows dorsal support strap 90 to be tensioned and capable of absorbing and moderating any vertical displacement of cartable item 160 (e.g., the bouncing experienced in cartable item 160 when a user walks). Of course, dorsal support strap 90 may comprise a single piece having a first end that attaches to carrying device 10 and a second end that attaches to golf bag 160, without more, or any combination of the elements described above.

Figure 12A:
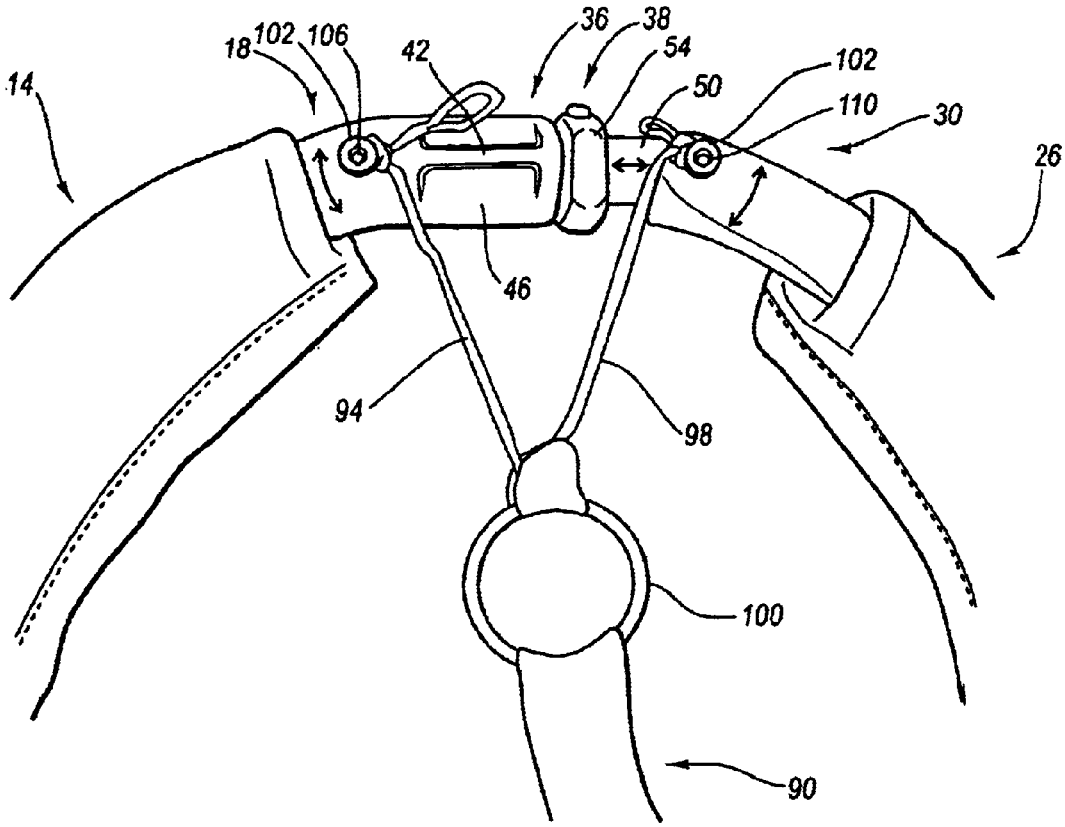
FIGS. 12-A and 12-B illustrate detailed views of two exemplary embodiments of the shoulder bridge comprising the adjustment area and two methods and designs for attaching the dorsal support strap to the carrying device.

As specifically shown in FIGS. 12-A and 12-B, dorsal support strap 90 comprises two separate strap extensions 94 and 98 that attach at two separate and spaced apart anchoring points 106 and 110, respectively, located on means for connecting (e.g., shoulder bridge 36) of carrying device 10. Anchoring points 106 and 110 are preferably spaced at equidistant locations as measured from a center point on means for connecting. First and second strap extensions 94 and 98 may be separate independent pieces coupled to dorsal support strap 90 through coupler 100 (e.g., a metal ring, etc.) and that split therefrom, or they may be integrally formed with primary strap portion 92, thus eliminating the need for a coupler device. Either way, it is preferred that dorsal support strap 92 couple to carrying device 10 in at least two locations.

Figure 12B:
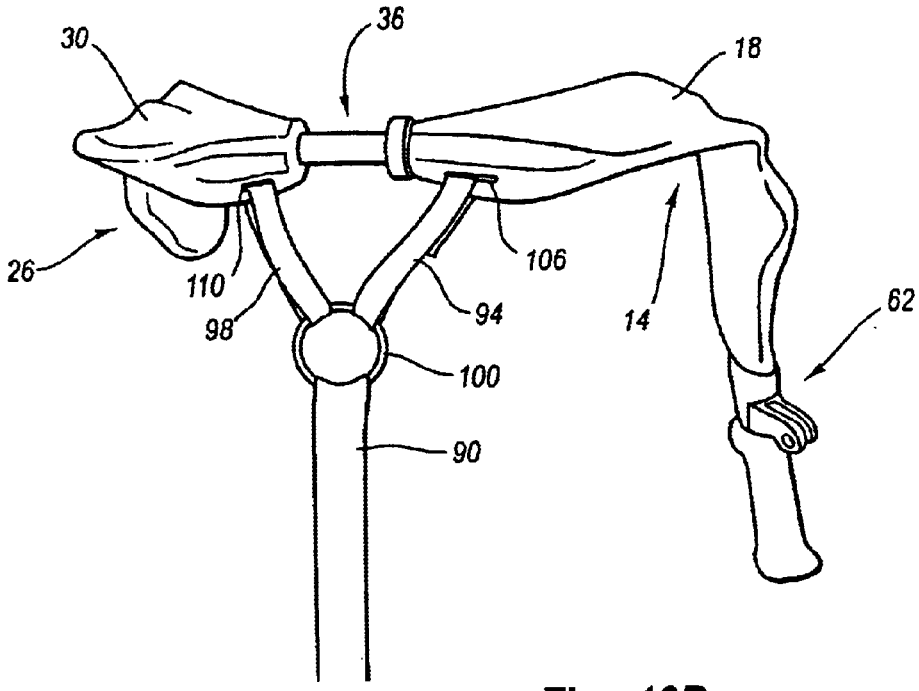

Also, specifically shown in FIGS. 12-A and 12-B, first and second anchoring points 106 and 110 are positioned on shoulder bridge 36. Anchoring points 106 and 110 may also be located on first and second shoulder areas 14 and 26, respectively. Preferably, anchoring points 106 and 110 are located in a top dead center position on shoulder bridge 36, wherein top dead center is defined as the relative location at the top and center of shoulder bridge 36 if viewing carrying device 10 from a top view, and wherein carrying device 10 is correctly positioned on a user in a dual-shoulder carrying arrangement (FIG. 12-A). However, anchoring points 106 and 110 may be positioned anywhere on shoulder bridge, as well as on primary and secondary shoulder areas 14 and 26, respectively, such as on primary and secondary shoulder frames 18 and 30 using a slot formed on primary and secondary shoulder frames 18 and 30 as shown in FIG. 12B.

Positioning first and second anchoring points 106 and 110 at the top dead center of shoulder bridge 36 (or primary and secondary shoulder frames 18 and 30) also creates a moment arm in dorsal support strap 90, wherein dorsal support strap 90 comprises a tendency to rotate carrying device 10 about the center axis of shoulder bridge 36 if pulled in a downward, vertical direction (e.g., by the weight of the attached cartable item) when carrying device 10 is on the shoulder(s) of the user. Moreover, positioning first and second anchoring points 106 and 110 at the top dead center functions to hold carrying device 10 more securely to the body of the user as the weight of golf bag 160, combined with the orientation of first and second strap extensions 94 and 98 connected to anchoring points 106 and 110, has a tendency to pull down carrying device 10 and cause it to rotate so as to pull shoulder bridge 36 more snugly into the neck area of the user. Furthermore, the top dead center positioning of anchoring points 106 and 110 and the relative attachment of first and second strap extensions 94 and 98 facilitates actuation of means for transitioning. Specifically, as golf bag 160 is attached and the user lifts carrying device 10 to a first shoulder, the resulting rotational movement about the central axis of shoulder bridge 36 has a tendency to push means for transitioning outward and upward, which is the normal path of movement undertaken to actuate the means for transitioning. As such, the user is not required to supply all of the force needed to actuate means for transitioning, but is rather assisted by the rotation of carrying device 10 caused by the positioning and orientation of the particular elements of dorsal support strap 90.

As mentioned, anchoring points 106 and 110 may be located on either shoulder bridge 36 or primary and secondary shoulder areas 14 and 26. Also, the present invention contemplates positioning anchoring points 106 and 110 at any position on these two locations, such as at the top dead center position discussed above, or at any offset position from the top dead center position, or along the bottom. And, the method of attachment may also be any known means, such as those shown in the Figures. Moreover, the dorsal strap may comprise a single attachment and attach to shoulder bridge 36 or primary or secondary shoulder areas 14 or 26 at one anchoring point located anywhere along shoulder bridge 36 or primary and secondary shoulder areas 14 and 26, rather than comprising the dual attachment system described above. The single attachment or anchoring point may also be located anywhere and use any means of attaching.

First and second strap extensions 94 and 98 extend from primary strap portion 92 and preferably attach to carrying device 10, and particularly anchoring points 106 and 110 of shoulder bridge 36 (or primary and secondary shoulder areas), along the outside perimeter of shoulder bridge 36. Stated differently, first and second strap extensions 94 and 98 preferably wrap around the outer frame portion of shoulder bridge 36, rather than underneath the frame portion of shoulder bridge 36 as shown in the drawings. However, it is also contemplated that first and second strap extensions 94 and 98 may alternatively be routed underneath the frame portion of shoulder bridge 36. Routing first and second strap extensions 94 and 98 above or beneath shoulder bridge 36 dictates or controls the rotational direction of carrying device 10 about the central axis of shoulder bridge 36 when dorsal support strap 90 is pulled in a downward, vertical direction. The above orientation of strap extensions 94 and 98 causes carrying device 10, and particularly shoulder bridge 36, to rotate away from cartable item 160, while an underneath rotation causes shoulder bridge 36 to rotate in the opposite direction, towards cartable item 160.

As stated, dorsal support strap 90 may also comprise a biasing member 114. Biasing member 114 may be placed on, coupled to, inserted into, or built into dorsal support strap 90 anywhere along its longitudinal length. In another exemplary embodiment, dorsal support strap 90 may be made of a biasing material, thus eliminating the need for an independent biasing device or member. Or, biasing member 114 may be eliminated entirely.

In one exemplary embodiment, biasing member 114 comprises an independent and separate piece attached in-line with primary strap portion 92, its particular positioning not critical to its function. Biasing member 114 functions to provide and introduce biased tensioning to dorsal support strap 90. Biasing member 114 further functions to absorb and moderate much of the vertical forces induced by and introduced within carrying device 10 as a result of the weight of cartable item 160.

Dorsal support strap 90 and lateral support strap also comprise adjustable, but identified lengths that allow cartable item 160 to be oriented in the most efficient and comfortable way. Preferably, these lengths allow cartable item 160 to be oriented transversally across the back of the user.

In another embodiment, dorsal support strap couples to dorsal brace 150 in a similar manner as described above and as shown in FIGS. 6-A and 6-B.

In reference to FIGS. 4, 7, 9, and 13–15, showing more particularly lateral support strap 126, lateral support strap 126 comprises a first end releasably attached to carrying device 10 via attachment means 134, a second end releasably attached to cartable item 160 at first attachment point 180 via attachment means 138, and an adjustment means 142 that allows the length of lateral support strap 126 to be adjusted as needed. In one exemplary embodiment, the first end of lateral support strap 126 attaches to a pivoting cuff 82 positioned on transitioning arm 62. Pivoting cuff 82 functions to allow transitioning arm 62 to be actuated (lifted and rotated) without interfering with the relative positioning of cartable item 160. Stated differently, pivoting cuff 82 functions to allow transitioning arm 62 to be actuated without significantly affecting or interfering with the relative position of the golf bag during the back and forth transition between a single-shoulder carrying arrangement and a dual-shoulder carrying arrangement. These functions are made possible as pivoting cuff 82 comprises both horizontal and vertical vectors resulting in a significant degree or range of rotational motion existing between 0 and 360 degrees, and preferably between 0 and 180 degrees. This feature also allows pivoting cuff 82 to significantly reduce rotation and over rotation of cartable item 160. By limiting the range of motion in pivoting cuff 82 (e.g., to 180 degrees), a correct amount and timing of tensioning is achieved that not only allows the present position of cartable item 160 to remain substantially unchanged during the transitioning process, but also provides a limited amount of movement in carrying device 10, which movement is common when walking or running while carrying a cartable item via a carrying device. Limiting the range of motion of cartable item 160 effectively reduces overly aggressive movement and rotation of cartable item 160 about the user's body. For example, during a round of golf it is not uncommon for the motion of the user, whether it be from walking or picking up or setting down of the golf bag, to cause the golf bag to swing, bounce, or rotate. Pivoting cuff 82 serves to limit the movement of the golf bag, while providing substantial freedom at the same time, if needed. Limiting the range of motion of pivoting cuff 82 also functions to facilitate the transitioning of cartable item 160 from a single-shoulder arrangement to a dual-shoulder arrangement. By not allowing pivoting cuff to rotate freely, a rotational force is induced within carrying device 10 due to the tensioning provided by cartable item 160 on pivoting cuff 82 as it is not allowed to rotate to an inline position where the moment is zero, but is rather maintained at an offset position where a moment is created. This moment existing in pivoting cuff 82 subsequently induces the resultant rotational force in carrying device 10 that facilitates the lifting and transitioning of secondary shoulder area 14 onto the second shoulder of the user. The degree of motion and its relative positioning is strategically designed so that transitioning is facilitated, but normal use and carrying of cartable item 160 is not interfered with.

In an alternative embodiment, pivoting cuff 82 may comprise means for locking pivoting cuff 82 in a desired position or orientation. Means for locking may be any known in the art, such as a pin insert, a stopper, etc. Being able to lock pivoting cuff 82 is advantageous in that there may be times when the user does not wish to allow any movement or range of motion in the cartable item about his or her body.

Figure 4:
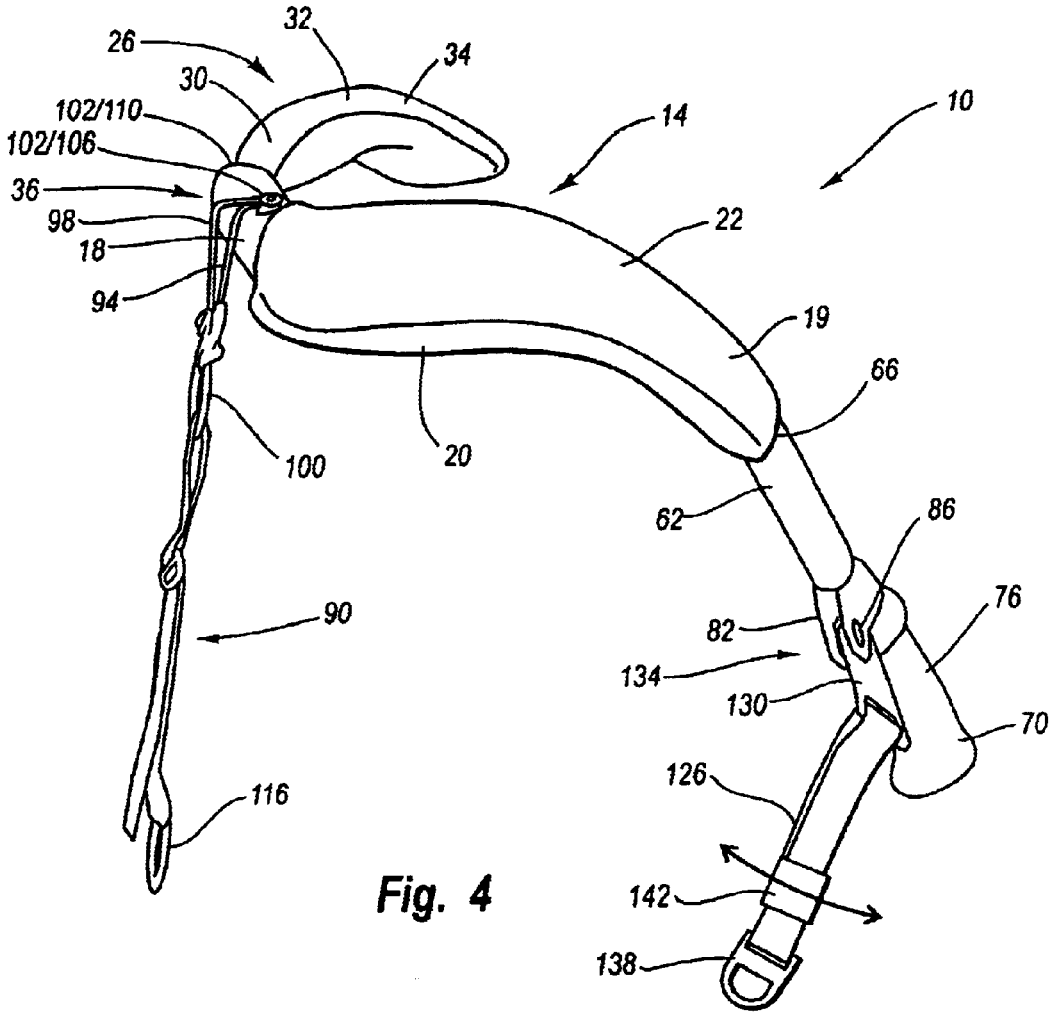
FIG. 4 illustrates a side view of the carrying device highlighting the primary shoulder area and primary shoulder frame, as well as the transitioning arm, grip, pivoting cuff, and secondary shoulder strap according to one exemplary embodiment of the present invention.
Figure 5:
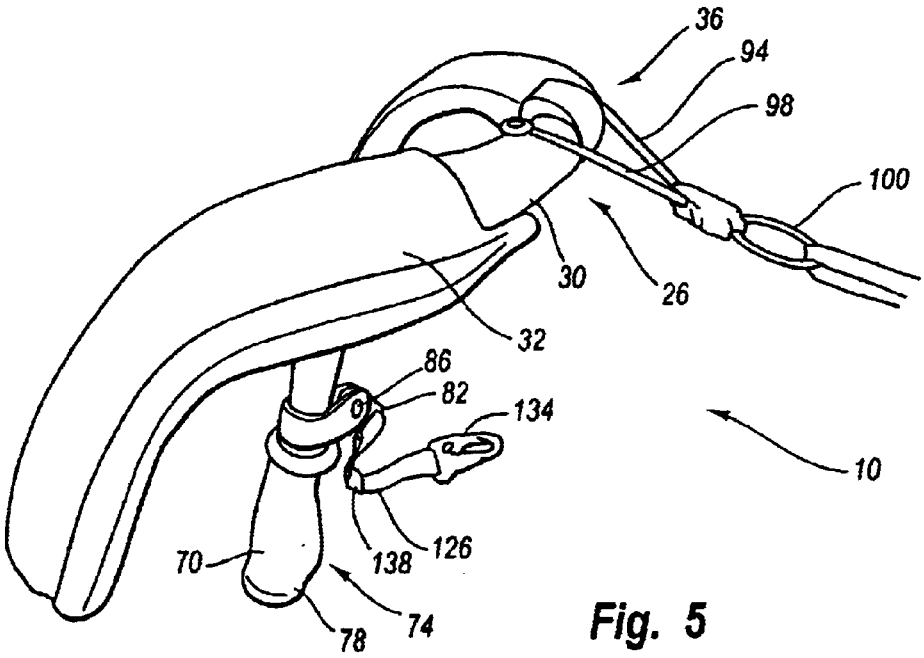
FIG. 5 illustrates a side view of the golf bag carrying device highlighting the secondary shoulder area and secondary shoulder frame according to one exemplary embodiment of the present invention.

Transitioning arm 62 and pivoting cuff 82 further feature a mounting point 86 for mounting the first end of lateral support strap to carrying device 10 and allowing lateral support strap to pivot about the central rotational axis of mounting point 86 as illustrated by the arrows in FIGS. 4 and 15. Mounting point 86 may also utilize any attachment means 134 commonly known in the art to attach lateral support strap 126 to pivoting cuff 82. Lateral support strap 126 is allowed to pivot in light of the upward and outward movement of transitioning arm 62 upon actuation. This pivoting feature further contributes to the stability of cartable item 160 during the transitioning phase, especially since lateral support strap 126 is preferably attached directly to transitioning arm 62, if included as a component.

In another exemplary embodiment shown in FIG. 9, lateral support strap 126 attaches to primary shoulder area 14, and particularly means for transitioning, in a much more simplified manner. Specifically, FIG. 9 shows lateral support strap 126 having a first end that is looped through an aperture or a slot 84 formed within primary shoulder area 14 and then secured in place by means commonly known in the art, such as by sewing the end of lateral support strap 126 to itself, or providing some type of releasable attachment means, such as a buckle, etc, or by coupling the first end subsequently to the cartable item. Other attachment methods may also be utilized, such as attaching the first end of strap 126 to carrying device using a snap or rivet, rather than an aperture and looping the strap there through. Essentially, any means of attaching lateral support strap 126 to carrying device 10 is contemplated and intended to be within the scope of the present invention in this embodiment where no pivoting cuff is used. It should be noted that in this embodiment, many of the advantages and benefits that are found with a pivoting cuff and mounting point are not included, but the simple design has its own advantages and benefits, such as being much cheaper to manufacture and produce. In addition, this embodiment significantly reduces the movement of the cartable item about the body of the user as no range of motion in the strap is provided for. This embodiment essentially functions similar to the one in which pivoting cuff 82 is locked in a given position or orientation. As in the above embodiment, lateral support strap 126 comprises a second end that releasably attaches to a cartable item as described above.

The second end of lateral support strap 126 attaches at first attachment point 180 located near the top front section of cartable item 160. First attachment point 180 positioned in this manner further contributes to the orientation of cartable item 160 transversely across the back of the user. Moreover, it also aids in stabilizing cartable item 160 by lessening the tendency of cartable item 160 to swing or over-rotate about the user's body.

Although the foregoing discussion pertaining to the strap assembly focused on dorsal and lateral strap supports 90 and 126, respectively, the present invention contemplates several other strap arrangements, designs, configurations, supports, etc. to attach carrying device 10 to a cartable item. As such, those discussed above should not be construed as limiting in any way as one ordinarily skilled in the art will recognize other strap arrangements that may be incorporated into the present invention carrying device.

For example, the in another exemplary embodiment, means for releasably attaching carrying device 10 to a cartable item 160, and particularly the support strap assembly, may further comprise a restraint 220 that attaches to carrying device 10 at at least one point on the means for engaging a first shoulder, and particularly primary shoulder area 14, or at least one point on the means for transitioning (e.g. comprising as transitioning arm 62 or a section of primary shoulder area 14), and extends around the body of the user in a direction opposite that of lateral support strap 126 and attaches to at least one point on cartable item 160. Restraint 220 is shown in FIGS. 9-A, 13, and 15. It is important to note that restraint 220 extends from a point on carrying device 10 and goes around the front of the body of the user to attach to cartable item 160 in an opposite direction than lateral support strap 126. Stated another way, restraint 220 is designed to extend from carrying device 10 on one side of the user across the front of the user and down a side of the user, while lateral support strap 126 is designed to extend from carrying device 10 on the opposite side of the user, thus allowing carrying device 10 to provide counter-rotational support to cartable item 160.

Restraint 220 functions to provide additional carrying support to cartable item 160. Restraint 220 also functions to allow carrying device 10 to comprise or possess additional and more beneficial stabilizing characteristics. Specifically, restraint 220 provides counter-rotational support to carrying device 10 opposite that provided by lateral support strap 126. As such, the two work together to provide lateral stability to carrying device 10. Means for attaching mainstay are similar to those described above for dorsal support strap 90 and lateral support strap 126. In addition, restraint 220 may comprise any means for adjusting as commonly known in the art to allow restraint 220 to be adjustable to accommodate different sized users.

While the present invention carrying device is applicable to several different type of cartable items, a preferred embodiment includes a carrying device adapted for use with a golf bag. As such, FIGS. 13–15 present or illustrate several different perspectives of an exemplary embodiment of carrying device 10 in which carrying device 10 comprises a golf bag carrying device. With reference to FIGS. 13–15 specifically, golf bag carrying device features a rigid structure comprising primary shoulder area 14, secondary shoulder area 26, shoulder bridge 36, transitioning arm 62 that transitions or converts golf bag carrying device between a single-shoulder carrying arrangement and a dual-shoulder carrying arrangement, adjustment assembly, and dorsal and lateral support straps 90 and 126 that function to releasably couple or attach golf bag carrying device 10 to a golf bag.

Primary shoulder area 14 comprises a primary shoulder frame 18 having a dorsal segment ergonomically and integrally formed with an anterior segment. Likewise, secondary shoulder area 26 comprises a secondary shoulder frame 30 having a dorsal segment ergonomically and integrally formed with an anterior segment.

Transitioning arm 62 is integrally formed with primary shoulder area 14 and extends therefrom for the purpose of effectuating the transitioning of secondary shoulder area 26 to engage a second shoulder of a user.

Some of the recognized benefits and advantages of the present invention over prior art golf bag carrying devices lies in the rigid composition of the present invention. Providing a rigid design helps improve posture while carrying bag between shots during a round of golf as the rigid anterior and dorsal segments are directly adjacent and pressed against the body of the user, thus keeping the golf bag in a more evenly distributed position. Closely related, the present invention carrying device also functions to absorb or assume of and better balance the weight distribution of the golf bag by transferring and spreading this weight distribution to and within the carrying device. These benefits lead to other benefits, such as a decrease in shoulder and back pain, an increase in stamina or a decrease in fatigue, and the alleviation of other common health problems associated with carrying a golf bag. Other advantages and benefits will be apparent to one ordinarily skilled in the art.

In still another alternative embodiment, the present invention features an adapter system for converting a pre-existing carrying device, such as a pre-existing single strap, into a single to dual-shoulder transitioning system as described herein. The adapter system comprises a rigid primary shoulder area comprising means for engaging a preexisting carrying device, wherein the primary shoulder area and the engaged pre-existing carrying device functioning to engage a first shoulder of a user. The adapter system further comprises a secondary shoulder area complimenting the primary shoulder area, wherein the secondary shoulder area is designed to be electively positioned on the second shoulder of the user. The secondary shoulder area preferably comprises a secondary shoulder frame having a substantially horizontal dorsal segment integrally formed with substantially vertical anterior segment. Moreover, the adapter system comprises a shoulder bridge connecting the primary shoulder area with the secondary shoulder area, wherein the shoulder bridge is designed to rest along the upper shoulder and lower neck portion of the user similar to other embodiments described above, and wherein the shoulder bridge comprising a centroidal axis. Finally, the adapter system comprises means for transitioning, preferably in the form of a transitioning arm, for transitioning the adapter system between a single-shoulder carrying arrangement and a dual-shoulder carrying arrangement, thus effectuating single to dual-shoulder support transitioning of the pre-existing carrying device.

Mainstay or Component Integration

The present invention carrying device further comprises a concept and several embodiments designed to utilize various components and/or mainstays pre-existing in a cartable item, and particularly backpacks. It is well known that many backpacks and other similar-type bags comprise a mainstay, such as an internal or external frame assembly, that functions to provide structural support to the backpack, as well as to provide additional carrying support to the backpack in conjunction with the particular type of carrying device employed, such as a strap or harness assembly. However, the strap assemblies existing on these backpacks possess the same problems as other prior art strap assemblies described above. Therefore, the present invention features a cartable item, and particularly a backpack, that eliminates strap assemblies entirely, or at least the primary strap assemblies as currently existing on many prior art backpacks. Whereas the means for carrying prior art backpacks typically comprised a primary strap assembly as commonly known in the art, the present invention features a new and unique means and method for carrying a backpack through integration and utilization of the rigid carrying device of the present invention, as described and shown herein, with one or more component structures already existing on the backpack. For example, in a mainstay backpack (one comprising an internal or external frame assembly—the mainstay), the carrying device is integrally formed with or coupled to the mainstay and functions as described above to provide the means for carrying the backpack on the shoulders of the user. In another example, in a soft form backpack (one having no internal or external frame assembly), the rigid carrying device can be coupled to or securely fastened to the backpack using any known means in the art. Essentially, this concept allows the carrying device to function as the primary means for carrying or supporting the backpack on the shoulders of the user, thus eliminating the need for a strap assembly as found on most prior art backpacks.

Specifically, the present invention features a cartable item comprising a main body defining one or more stowage areas; a mainstay providing structural support to the main body; a carrying device integrally formed with or removably or securely coupled to the mainstay and adapted to support carrying of the cartable item on the shoulders of a user. The carrying device specifically comprises means for engaging a first shoulder of a user to support the cartable item, wherein the means for engaging a first shoulder comprises a rigid primary shoulder area; means for electively engaging a second shoulder of a user to provide further carrying support of the cartable item, wherein the means for engaging a second shoulder comprises a rigid secondary shoulder area; means for connecting the primary shoulder area to the secondary shoulder area; and means for transitioning, in a single, efficient motion, the carrying device between a single-shoulder carrying position and a dual-shoulder carrying position.

Figure 17:
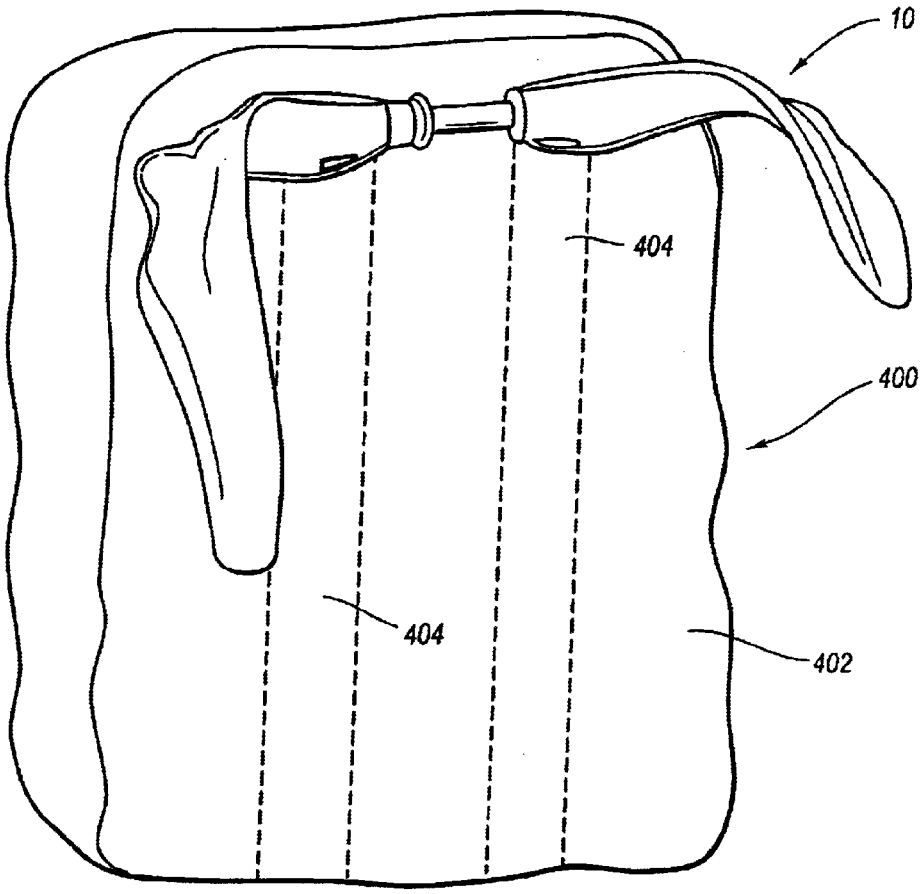
FIG. 17 illustrates the mainstay integration concept of the present invention, and particularly a cartable item in the form of a backpack that does not comprise straps or harnesses, but a carrying device as described herein integrally formed with a frame assembly of the backpack.

In one exemplary embodiment, shown in FIG. 17, backpack 400 is a mainstay backpack comprising an external mainstay or frame assembly. However, backpack 400 does not comprise a primary strap assembly as commonly found in prior art mainstay backpacks. Instead, backpack 400 comprises carrying device 10 integrally formed with mainstay 404 as a unitary piece. Of course, carrying device 10 may also be coupled to mainstay 404 rather than integrally formed therewith using one or more attachment means. Attachment means for attaching or coupling carrying device 10 to mainstay 404 may comprise any of those known in the art. In addition, mainstay 404 may be an internal mainstay rather than the external mainstay shown in FIG. 17.

Carrying device 10 comprises all of the components and features described herein, including all recited and inherent embodiments, and functions in the manner as described and taught herein.

In another exemplary embodiment, as shown in FIGS. 6-A and 6-B and described above, carrying device 10 may comprise a dorsal brace 150 that may be integrally formed with or securely coupled to backpack 400 shown in FIG. 17. Dorsal brace may be attached on the outside of backpack 400 or may be sewn into the fabric makeup of backpack 400. In this embodiment, dorsal brace 150 may function as described above, but may also function as a frame assembly as found in prior art mainstay backpacks.

Other embodiments of the present invention mainstay and/or component integration concept will be apparent and obvious to one ordinarily skilled in the art. As such, those specifically recited herein are not meant to be limiting in any way.

Method of Operation and Function of the Golf Bag Carrying Device and System

With reference to FIGS. 14 and 15, shown is the single-shoulder carrying arrangement or positioning and the transitioned dual-shoulder carrying arrangement or positioning, respectively, of carrying device 10 (or golf bag carrying device 10) as attached to or adapted to receive a cartable item in the form of a golf bag. Although the present invention methods may be adaptable to any cartable item, many of the embodiments described and shown herein comprise a golf bag. As such, the present invention illustrates and features a method for carrying a golf bag, and also more particularly a method for transitioning carrying device 10 from a single-shoulder carrying arrangement to a dual-shoulder carrying arrangement, thus effectuating single to dual-shoulder support transitioning of golf bag carrying device 10.

In the single-shoulder position, as illustrated in FIG. 8, secondary shoulder area 26, and particularly secondary shoulder frame 30, exists in a latent or inactive, off-shoulder position, while primary shoulder area 14, and primary shoulder frame 18, function to engage a first shoulder of the user to allow the user to carry the golf bag with golf bag carrying device 10 engaging only one shoulder.

In the dual-shoulder position, as illustrated in FIG. 15, secondary shoulder area 26 compliments first shoulder area 14 in engaging a second shoulder of a user to allow the user to carry the golf bag with golf bag carrying device 10 engaging both shoulders. Secondary shoulder area thus becomes functional by being placed in an active, secondary golf bag supporting position located on the opposing shoulder of the user.

Specifically, the present invention features a method for carrying a golf bag, wherein the method comprises the steps of: causing a primary shoulder area of a golf bag carrying system to engage a first shoulder of a user; and actuating, electively, means for transitioning (shown as transitioning arm 62) located on the golf bag carrying system to cause a secondary shoulder area of the golf bag carrying system to engage a second shoulder of a user, wherein the step of actuating causes the secondary shoulder area to transition and convert from a latent and inactive, off-shoulder position to an active, secondary golf bag supporting position, thus effectuating single to dual-shoulder support transitioning of the golf bag carrying system.

This particular method further comprises the step of actuating means for transitioning to cause the secondary shoulder area to release and disengage the second shoulder of the user, wherein the step of actuating causes the secondary shoulder area to transition and convert from an active, secondary golf bag supporting position to a latent and inactive, off-shoulder position, or rather, this step transitions the carrying device from a dual-shoulder carrying arrangement to a single-shoulder carrying arrangement. This transition may be effectuated as often as desired by the user.

The present invention further features a method for transitioning a golf bag carrying device from a single-shoulder carrying arrangement or position to a dual-shoulder carrying arrangement or position. This method comprises the steps of: placing a primary shoulder frame of a golf bag carrying device on a first shoulder; actuating a transitioning arm extending from the primary shoulder frame by lifting and rotating the transitioning arm to effectuate conversion of a secondary shoulder frame from an off-shoulder position to an engaged, on-shoulder position; and releasing the transitioning arm to return to its supported position, wherein the secondary shoulder frame engages a second shoulder of said user.

Still further the present invention comprises a method of fitting a carrying device to a pre-existing strap of a cartable item. In this embodiment, the method comprises fitting a carrying device comprising a primary shoulder area, a secondary shoulder area, and means for transitioning the carrying device between and single-shoulder carrying arrangement and a dual-shoulder carrying arrangement. In this embodiment, the primary shoulder area is capable of fitting with a pre-existing strap of a cartable item.

The carrying device described and illustrated herein is designed to transition between a single-shoulder carrying arrangements and a dual-shoulder carrying arrangement, wherein initially, the carrying device engages a first single shoulder of a user as described above. However, the present invention further features a method for initially engaging both the shoulders of a user simultaneously, or substantially simultaneously. Stated another way, the present invention further features a method of allowing the user to utilize the carrying device to carry a cartable item with the intention of lifting the carrying device and initially causing it to engage both shoulders in the dual-shoulder carrying arrangement, rather than a single-shoulder and actuating the means for transitioning to transition the carrying device from a single-shoulder carrying arrangement to a dual-shoulder carrying arrangement. This particular method still allows the user to transition the carrying device back and forth between these two arrangements, but the initial engagement is with both shoulders of the user. As such, to carry the cartable item according to this particular method, the user initially positions the carrying device on both shoulders, such that the carrying device is in its dual-shoulder carrying arrangement. As said, subsequent transitioning from the dual-shoulder carrying arrangement to the single-shoulder carrying arrangement and back again is still made possible.

The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A carrying device adapted to enable the carrying of a cartable item, said carrying device comprising:

means for engaging a first shoulder of a user to support carrying of a cartable item, said means for engaging a first shoulder comprising a rigid primary shoulder area;

means for electively engaging a second shoulder of a user to provide further carrying support of said cartable item, said means for engaging a second shoulder comprising a rigid secondary shoulder area;

means for connecting said primary shoulder area to said secondary shoulder area;

means for transitioning, in a single, efficient motion, said means for electively engaging a second shoulder between a first latent and inactive, off-shoulder position to a second active, secondary cartable item supporting position, wherein said secondary shoulder area is caused to engage said second shoulder of said user, thus effectuating single to dual-shoulder carrying of said carrying device; and means for releasably attaching said carrying device to said cartable item.

2. The carrying device of claim 1, wherein said rigid primary shoulder area comprises an anterior segment and a dorsal segment.

3. The carrying device of claim 1, wherein said rigid secondary shoulder area comprises an anterior segment and a dorsal segment.

4. The carrying device of claim 1, wherein means for transitioning comprises a grip and a palm rest.

5. The carrying device of claim 1, wherein said means for transitioning comprises a section of said primary shoulder area that can be grasped by said user for the purposes of effectuating the transitioning of said means for electively engaging a second shoulder of a user.

6. The carrying device of claim 1, wherein said means for engaging a primary shoulder area, said means for electively engaging a secondary shoulder area, said means for connecting, and said means for transitioning are all integrally connected and formed together and comprises a unitary structure.

7. The carrying device of claim 1, wherein said means for engaging a primary shoulder area, said means for electively engaging a secondary shoulder area, said means for connecting, and said means for transitioning comprises individual and independent components that are each releasably and removably coupled to one another at their respective locations.

8. The carrying device of claim 1, further comprising means for adjusting said carrying device to fit several users.

9. The carrying device of claim 8, wherein said means for adjusting comprises an adjustment assembly positioned between said primary and secondary shoulder areas to allow relative movement there between, said adjustment assembly comprising:

a coupling attached to one of said primary and secondary shoulder areas;

an insert member also attached to one of said primary and secondary shoulder areas opposite said coupling, said insert member slidably and rotatably mounted within said coupling; and means for locking said insert member in a set position within said coupling, wherein said carrying device may be precisely adjusted to the preference of said user.

10. The carrying device of claim 1, wherein said means for connecting said primary shoulder area to said secondary shoulder area comprises a shoulder bridge.

11. The carrying device of claim 10, wherein said shoulder bridge is rigid.

12. The carrying device of claim 1, wherein said shoulder bridge is flexible.

13. The carrying device of claim 13, wherein said means for transitioning comprises a transitioning arm extending from said primary shoulder area.

14. The carrying device of claim 13, wherein said transitioning arm is releasably and removably coupled to said primary shoulder area.

15. The carrying device of claim 13, wherein said transitioning arm is integrally formed with said primary shoulder area.

16. The carrying device of claim 1, wherein said means for releasably attaching said carrying device to said cartable item comprises a support strap assembly, said support strap assembly comprising:

an adjustable dorsal support strap having first and second ends;

an adjustable lateral support strap; and attachment means adaptable to attach said adjustable dorsal support strap and said adjustable lateral support strap to said carrying device and said cartable item.

17. The carrying device of claim 16, wherein said support strap assembly comprises multiple strap supports attachable at multiple points on said cartable item.

18. The carrying device of claim 16, wherein said dorsal support strap and said lateral support strap comprise a single strap design and are attachable to said cartable item at multiple attachment points, and are also capable of switching between or automatically adjusting to several attachment point locations to account for various environmental and load conditions experienced while carrying said cartable item.

19. The carrying device of claim 16, wherein said dorsal strap comprises first and second strap extensions attached to said means for connecting, said first strap and second strap extensions attached at equidistant positions from a center point on said means for connecting.

20. The carrying device of claim 16, wherein said adjustable lateral support strap attaches to said transitioning means.

21. The carrying device of claim 16, wherein said adjustable lateral support strap attaches to said primary shoulder area.

22. The carrying device of claim 16, wherein said adjustable dorsal support strap attaches to said primary and secondary shoulder areas of said carrying device.

23. The carrying device of claim 16, further comprising a restraint that attaches to at least one point on said carrying device and extends in an opposite direction from said lateral support strap and attaches to at least one point on said cartable item.

24. The carrying device of claim 23, wherein said restraint comprises a first end that attaches to said means for engaging a first shoulder of a user and a second end that attaches to said cartable item.

25. The carrying device of claim 23, wherein said restraint comprises a first end that attaches to said means for transitioning and a second end that attaches to said cartable item.

26. The carrying device of claim 1, wherein said secondary shoulder area comprises a lockable positioning module designed to allow said secondary shoulder area to be adjustable and positionable in one of a plurality of lockable interim positions made available by said lockable positioning module.

27. The carrying device of claim 26, wherein said lockable positioning module couples an anterior section of said secondary shoulder area to a dorsal section of said secondary shoulder area, wherein said dorsal section rotates with respect to said anterior section through said various lockable interim positions, thus effectuating said adjustment and positioning of said secondary shoulder area.

28. The carrying device of claim 26, wherein said lockable positioning module is situated at the junction of said secondary shoulder area and said means for connecting, wherein said secondary shoulder area rotates, in its entirety, about said means for connecting.

29. The carrying device of claim 26, wherein said lockable positioning module functions to lock said secondary shoulder area in one of a plurality of interim positions.

30. The carrying device of claim 26, wherein said lockable positioning module comprises a range of motion allowing said secondary shoulder area to rotate between 0 and 180 degrees.

31. The carrying device of claim 26, wherein said lockable positioning module is selected from the group consisting of a quick release mechanism, a ratchet mechanism, a slot and insert assembly, and other similar mechanisms and assemblies.

32. A carrying device adapted to enable the carrying of a cartable item, said carrying device comprising:

a primary shoulder area comprising a primary shoulder frame, said primary shoulder area designed to be initially positioned on a first shoulder of a user to support a cartable item;

a secondary shoulder area complimentary to said primary shoulder area and adapted to be electively positioned on the second shoulder of said user, said secondary shoulder area comprising a secondary shoulder frame;

a shoulder bridge connecting said primary shoulder area with said secondary shoulder area;

a transitioning arm functioning to effectuate, in a single, efficient motion, the engagement, by said secondary shoulder frame, of a second shoulder of said user by transitioning said secondary shoulder frame from a first latent and inactive, off-shoulder position to a second active, carrying support position, thus effectuating single to dual-shoulder carrying support transitioning of said carrying device;

an adjustment area comprising an adjustment assembly for selectively adjusting said primary shoulder area relative to said secondary shoulder area and body of said user; a dorsal support strap releasably coupled to said primary and secondary shoulder frames at respective anchoring points, said dorsal support strap adapted to couple said carrying device to a first attachment point on said cartable item; and a lateral support strap releasably coupled to said transitioning arm at an anchoring point, said lateral support strap adapted to couple said carrying device to a second attachment point located on said cartable item.

33. A carrying device for effectuating single to dual-shoulder support transitioning, said carrying device comprising:

an active, rigid primary shoulder area comprising dorsal and anterior frame segments and adapted to engage a first shoulder of a user; a rigid secondary shoulder area connected to said primary shoulder area, said secondary shoulder area also comprising dorsal and anterior frame segments and adapted to electively engage a second shoulder of said user;

a transitioning arm integrally coupled to said primary shoulder area, said transitioning arm functioning to electively activate said secondary shoulder area transitioning, in a single, efficient motion, said secondary shoulder area from a first latent and inactive, off-shoulder position to an active, secondary bag supporting position, thus effectuating single to dual-shoulder support transitioning of said carrying device.

34. A carrying device comprising:

means for engaging a first and, electively, a second shoulder of a user, said means comprising a rigid primary shoulder frame and a rigid secondary shoulder frame, respectively, each shoulder frame having a substantially horizontal dorsal segment integrally formed with a substantially vertical anterior segment; a transitioning arm that, upon actuation, causes said means for engaging to engage said second shoulder of said user in a single, efficient motion;

an adjustment assembly operable with said means for engaging, that functions to adjust said golf bag carrying device to a desired ergonomic configuration, said attachment assembly comprising:

a coupling attached to one of said primary and secondary shoulder frames; an insert member also attached to one of said primary and secondary shoulder frames opposite said coupling, said insert member slidably and rotatably mounted within said coupling; means for locking said insert member in a set position within said coupling, wherein said golf bag carrying device may be precisely adjusted to the desired preference of said user; and a support strap assembly for attaching said carrying device to a cartable item.

35. The carrying device of claim 34, wherein said means for engaging comprises a rigid makeup.

36. The carrying device of claim 34, wherein said means for locking comprises a quick release mechanism.

37. The carrying device of claim 34, wherein said means for locking comprises a threaded finger tightening member.

38. The carrying device of claim 34, wherein said means for locking comprises an index module allowing for pre-set position adjustment of said insert member within said coupling.

39. The carrying device of claim 34, wherein said cartable item is selected from the group consisting of a golf bag, a piece of luggage, a backpack, a mail bag, a military bag, and other similar items.

* * * * *